US012188194B2

(12) United States Patent
Duquette et al.

(10) Patent No.: US 12,188,194 B2
(45) Date of Patent: Jan. 7, 2025

(54) ZERO-ASCEND OMNISPECIES (ZAO) PREFABRICATED FISH PASSAGE ATTRACTION SYSTEM

(71) Applicant: LITTORAL POWER SYSTEMS, INC., New Bedford, MA (US)

(72) Inventors: David J. Duquette, Fairhaven, MA (US); Katherine Leighton, Media, PA (US); Luke Graham, Eagle River, AK (US); Vincent Bryan, Seattle, WA (US)

(73) Assignee: LITTORAL POWER SYSTEMS, INC., New Bedford, MA (US)

( * ) Notice: Subject to any disclaimer, the term of this patent is extended or adjusted under 35 U.S.C. 154(b) by 0 days.

(21) Appl. No.: 17/860,740

(22) Filed: Jul. 8, 2022

(65) Prior Publication Data

US 2023/0011618 A1 Jan. 12, 2023

Related U.S. Application Data

(60) Provisional application No. 63/219,666, filed on Jul. 8, 2021.

(51) Int. Cl.
*E02B 8/08* (2006.01)

(52) U.S. Cl.
CPC ..... *E02B 8/085* (2013.01)

(58) Field of Classification Search
CPC ..... E02B 8/08; E02B 8/085
USPC ..... 405/81, 82; 119/219
See application file for complete search history.

(56) References Cited

U.S. PATENT DOCUMENTS 3,754,348 A * 8/1973 Ramsey ..... A01K 69/08 43/103
5,161,913 A * 11/1992 Boylan ..... E02B 8/085 405/83
6,712,555 B1 3/2004 Truebe et al.
2020/0217032 A1 7/2020 Aittaniemi
2020/0370262 A1 11/2020 Leighton et al.

FOREIGN PATENT DOCUMENTS

EP 1852554 A2 * 11/2007 ..... E02B 8/085

OTHER PUBLICATIONS

DE 4241946, 9 pages. (Year: 1993).*
"International Search Report and Written Opinion received for PCT Patent Application No. PCT/US2022/036515, mailed on Oct. 25, 2022", 12 pages.

* cited by examiner

*Primary Examiner* — Sunil Singh
(74) *Attorney, Agent, or Firm* — ADLER POLLOCK & SHEEHAN P.C.

(57) ABSTRACT

Zero-ascend omnispecies (ZAO) attraction system includes a fish passage attraction module that can be deployed in a fishway where water flows downstream. The fish passage attraction module includes a body having a first end and an opposite second end, first adaptor adjacent the first end and second adaptor adjacent the second end. The adaptors are configured to alter water flow fields downstream of the module so as to attract fish to an entrance thereof.

20 Claims, 18 Drawing Sheets

| Total Number of Piles | Soil Type | Pile Diameter (in) | Wall Thickness (in) | Deflection at Top of Pile (in) | Deflection at Mudline (in) | Depth to Fixity below Mudline (ft) | Comment |
|---|---|---|---|---|---|---|---|
| 4 | Granular Soils | 24 | 1 | 7.9 | 1.1 | 41 | Excessive Deflection |
| | | 30 | 5/8 | 6.0 | 0.80 | 41 | Top = No Good, Mudline = OK |
| | | 30 | 1 | 4.0 | 0.58 | 44 | Deflection OK |
| | | 36 | 3/4 | 3.0 | 0.42 | 46 | Deflection OK |
| | Cohesive Soils | 24 | 5/8 | 10 | 1.0 | 35 | Top = No Good, Mudline = OK |
| | | 24 | 1 | 6.7 | 0.70 | 34 | Top = No Good, Mudline = OK |
| | | 30 | 1 | 3.5 | 0.40 | 35 | Deflection OK |
| | | 36 | 5/8 | 3.0 | 0.35 | 35 | Deflection OK |
| 8 | Granular Soils | 24 | 1 | 3.7 | 0.44 | 40 | Deflection OK |
| | | 30 | 5/8 | 2.8 | 0.34 | 41 | Deflection OK |
| | | 30 | 1 | 1.9 | 0.25 | 44 | Deflection OK |
| | | 36 | 3/4 | 1.5 | 0.20 | 46 | Deflection OK |
| | Cohesive Soils | 24 | 5/8 | 4.5 | 0.38 | 29 | Top = No Good, Mudline = OK |
| | | 24 | 1 | 3.1 | 0.27 | 29 | Deflection OK |
| | | 30 | 1 | 1.6 | 0.15 | 31 | Deflection OK |
| | | 36 | 5/8 | 1.4 | 0.12 | 31 | Deflection OK |

FIG. 6B

| Interface Friction Category | Representative Soil Type Descriptions | Unfactored Horizontal Load (lbs) | Unfactored Vertical Load (lbs) | Interface frictional coefficient $f$ (tan $\xi$) | Approx. Friction Angle $\xi$ (°) | Dead Weight of Anchor Required (lbs / ton) | Approx. Volume of Concrete Required ($ft^3$) per Anchor | Approx. Horizontal Dimension (ft) – 2-m high block |
|---|---|---|---|---|---|---|---|---|
| Low | Fine sandy silt, non-plastic silt | 12,550 | 4,486 | 0.2 | 11 | 190,344 / 95 | 1,270 | 13.9 |
| | | | | 0.3 | 17 | 129,457 / 65 | 860 | 11.5 |
| Medium | Clean sand, silty sand-gravel mixture | | | 0.35 | 19 | 112,060 / 56 | 750 | 10.7 |
| | | | | 0.4 | 22 | 99,012 / 50 | 660 | 10.0 |
| High | Clean gravel, gravel-sand mixture | | | 0.45 | 24 | 88,865 / 44 | 590 | 9.5 |
| | | | | 0.70 | 35 | 59,871 / 30 | 400 | 7.8 |
| Concrete | Concrete | | | 0.70 | 35 | 59,871 / 30 | 400 | 7.8 |

FIG. 7C

ZERO-ASCEND OMNISPECIES (ZAO) PREFABRICATED FISH PASSAGE ATTRACTION SYSTEM

CROSS-REFERENCE TO RELATED APPLICATIONS

This application claims the benefit of U.S. Provisional Application No. 63/219,666 filed Jul. 8, 2021, which is incorporated herein by this reference.

STATEMENT REGARDING GOVERNMENT INTEREST

This invention was made with government support under DE-EE-0008969 awarded by the Department of Energy. The government has certain rights in the invention.

FIELD OF THE INVENTION

The present invention relates generally to fish passage at dams and hydroelectric facilities, and more specifically, an attraction flow system that attracts fish to the entrance of a fishway.

BACKGROUND OF THE INVENTION

Hydropower or water power is power derived from the energy of falling or fast-running water, which may be harnessed for useful purposes. Since ancient times, hydropower from many kinds of watermills has been used as a renewable energy source for irrigation and the operation of various mechanical devices. In the late 19th century, hydropower became a source for generating electricity. Since the early 20th century, the term has been used almost exclusively in conjunction with the modern development of hydroelectric power. International institutions such as the World Bank view hydropower as a means for economic development without adding substantial amounts of carbon to the atmosphere, but dams can have significant negative environmental impacts.

One of the most problematic environmental issues is blocked passage for migratory fish, particularly anadromous and catadromous species. Hydropower licensing agencies, such as the Federal Energy Regulatory Commission (FERC), routinely require as a condition of operation that safe, timely and effective fish passage equipment at any hydropower plant be provided for. The problem is that doing so in a manner that is acceptable to authorities and stakeholders is extremely expensive, especially at smaller hydropower facilities where it becomes a disproportionate part of project cost and as such can render such efforts financially unworkable.

The US Fish and Wildlife Service (USFWS) defines a fishway as: the combination of elements (structures, facilities, devices, project operations, and measures) necessary to ensure the safe, timely, and effective movement of fish past a barrier. Examples include, but are not limited to, volitional fish ladders, fish lifts, bypasses, guidance devices, zones of passage, operational flows, and unit shutdowns. The terms "fishway," "fish pass," or "fish passageway" (and similarly "eelway," "eel pass," or "eel passageway") are interchangeable. In some instances, the terms "fishway" or "eelway" consistent with 16 U.S.C. § 811 (1994) can read as: "[t]hat the items which may constitute a 'fishway' under section 18 for the safe and timely upstream and downstream passage of fish shall be limited to physical structures, facilities, or devices necessary to maintain all life stages of such fish, and project operations and measures related to such structures, facilities, or devices which are necessary to ensure the effectiveness of such structures, facilities, or devices for such fish." The term "fish passage" (or "eel passage") refers to the act, process, or science of moving fish (or eels) over a stream barrier (e.g., dam).

Commonly utilized fishways for upstream fish passage include fish ladders, fish lifts, locks, and trap & haul programs that capture and truck fish past barriers for release back in-stream. Fish passage includes these fishways but also extends laterally and upstream and downstream to encompass the full zone of passage, which "refers to the contiguous area of sufficient lateral, longitudinal, and vertical extent in which adequate hydraulic and environmental conditions are maintained to provide a route of passage through a stream reach influenced by a dam (or stream barrier)."

The fish passage landscape is changing. Regulation driven by environmental impacts have changed favoring small hydropower that makes paying for fish passage extremely challenging: so much so that some hydropower facilities up for relicensing have decided to close down rather than pay to add fish passage required for their new license. Demands for fish passage are tightening seeking volitional passage while at the same time the list of protected species is growing. Responding to the needs for lower cost and ecologically friendly hydropower, the Department of Energy has been funding the development of a new way of approaching hydropower called Standard Modular Hydropower, resulting in new exemplary design envelope specifications. This changing landscape, described in more detail below, is why the subject invention is necessary.

Low-head hydropower resources are widespread, and represent an enormous opportunity to develop reliable baseload power. However, the industry requires a number of technology innovations and new design philosophies in order to cost-effectively develop them in balance with maintaining highly valued river functions, crucially including safe, timely and effective fish migration. Significant growth opportunities exist for a next generation of hydropower techniques that are smaller in scale, ecologically friendly and less expensive to build. Addressing this need, prefabricated, modular low-head hydropower systems have been developed, similar to those described in U.S. Pat. No. 10,626,569 and US Patent Application No. 2020/0370262, each of which is incorporated herein by reference. In addition, small hydropower plant assembled from the shop-built standardized modules can be designed, built and installed at a 30% lower initial capital cost than a conventional facility. If that cost goal is to be achieved, low-cost and efficient fish passage designs need to be deployed.

As is well known to developers and owners faced with fish passage issues, adding fishways that meet regulatory/agency approval is a significant cost. At <10 MW installations—where it would be fair to say that the bulk of current opportunities lie in light of the Hydropower Regulatory Efficiency Act of 2013 and the streamlined regulations promulgated by the FERC thereunder—as a percentage of overall cost, fish passage costs become a huge issue. For example, Pacific Gas & Electric (PG&E) is not going to relicense the 9.2 MW Potter Valley project in California due to the requirement to provide fish passage and the exorbitant cost of traditional fishway structures. PG&E announced in 2019 that it is cutting its losses as it will not seek a new federal license.

On the very small side, the issue is even more disproportionate. A 2018 cost workup by the Nature Conservancy for adding fishways to two very small dams in Yarmouth, Maine (one 12' of gross head, one 10') estimated that the cost of adding upstream fish passage to each would be about $2.5 million. These numbers simply will not work for small hydro developers in most cases.

Fishways commonly divert water from the head pond and include features within the fishway to achieve the hydraulic conditions (e.g., flow, velocity, depth) that are conducive to upstream migration. The amount of head pond flow diverted to the fishway to accommodate fish passage represents up to 10% of available flows. These head pond flows would otherwise be used to generate electricity—making the cost impacts even more painful. In addition, effective fish passage requires that the fish find and enter the entrance of the fishway without delay, which is accomplished by creating hydraulic signals that attract them to the entrance. In most operating conditions fishways do not discharge enough flow to effectively attract fish to the entrance, especially with competing flows for instance from turbine discharge through draft tubes or spillway flows. To create sufficient attraction flows many fishways need auxiliary water from the head pond and often requires pumps that take parasitic power from the generators.

Whooshh Innovations, Inc., based in Seattle, Washington, has been addressing the needs for cost-effective fish passage since 2014, with the introduction of its salmon cannon, and today offers fish transport systems for a range of anadromous and catadromous species, including sorting and invasive species blocking. These systems have demonstrated that fish can be transported up and over a dam without "wasting" power-generating flows. The Whooshh system uses water from the tailrace (below the dam) for the water needs of the system including generating attraction flows. The Whooshh Fish Transport System (WFTS) with attraction flows, reported to be approximately 5 cfs have demonstrated attraction, volitional salmonid entry and transport through the WFTS. The USFWS fishway engineers for the Northeast Region, however, recommend that "fishways be designed for a minimum attraction flow per fishway equal to 5% of the total station hydraulic capacity or a flow rate of 50 cfs, whichever is greater."

As such, there is a need for a low-cost system to attract fish to a fishway that does not rely on flows from the head pond or on parasitic power for pumps, that is volitional, and that attracts a wide variety of species for fish passage.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

This invention is for prefabricated fish passage attraction modules with zero ascension specifically pertaining to the design/mechanics of redirecting the outflow from the hydropower generators for fish attraction rather than having the outflow compete with the fish attraction, and to the vessel design that creates an attractor flow pattern that separates the attraction flow from the fishway entry flow as set forth below.

Disclosed is a fish passage attraction module according to an embodiment of the present disclosure. In this embodiment, the module includes a body having a downstream end and an adaptor adjacent the downstream end, the adaptor having a tapered structure so as to alter first flow field and second flow field adjacent the downstream end. In one embodiment, the first flow field is slower than the second flow field, and the first flow field is closer to a central longitudinal axis than the second flow field such that greater number of fish is attracted to move toward the first flow field than the second flow field.

In one embodiment, the body of the module includes an upstream end opposite the downstream end, whereby the adaptor adjacent the downstream end is a first adaptor, the module further includes a second adaptor adjacent the upstream end, the second adaptor having a conical structure so as to alter at least one of the first flow field and the second flow field. In another embodiment, the module further includes a tube disposed about a center of the body, the tube configured to alter at least one of the first flow field and the second flow field. In one embodiment, the body of the module includes a peripheral surface between the downstream end and the upstream end, the module further includes a third adaptor adjacent the peripheral surface, the third adaptor having a geometrical structure so as to alter at least one of the first flow field and the second flow field.

In some embodiments, a portion of at least one of the body, the first adaptor, the second adaptor, and the third adaptor, extends to a riverbed to serve as foundation for securing the module to the riverbed. In some embodiments, at least a portion of at least one of the body, the first adaptor, the second adaptor, and the third adaptor, is underwater. In other embodiments, at least one of the body, the first adaptor, the second adaptor, and the third adaptor, is fully submerged underwater.

In one embodiment, the module further includes a pump coupled to a portion of the body, the pump configured to alter at least one of the first flow field and the second flow field. In another embodiment, the module further includes a device coupled to a portion of the body, the device configured to attract a variety of fish toward the downstream end.

Disclosed is a fish passage attraction module according to an embodiment of the present disclosure, the module having a body having a downstream end and an opposite upstream end, first adaptor adjacent the upstream end, the first adaptor having a conical structure, and second adaptor adjacent the downstream end, the second adaptor having a tapered structure so as to alter first flow field and second flow field adjacent the downstream end.

In this embodiment, the first flow field is slower than the second flow field, and the first flow field is closer to a central longitudinal axis than the second flow field such that greater number of fish is attracted to move toward the first flow field than the second flow field. Fish entering the body from the downstream end may subsequently move toward the upstream end of the module.

In one embodiment, the module further includes a pump and a device each coupled to a portion of the body, the pump configured to alter water flow fields adjacent the body and the device configured to attract a variety of fish toward the downstream end of the body. In one embodiment, the body of the module includes a peripheral surface between the downstream end and the upstream end, the module further including a third adaptor adjacent the peripheral surface, the third adaptor having a geometrical structure so as to alter at least one of the first flow field and the second flow field. In some embodiments, at least one of the body, the first adaptor, the second adaptor, and the third adaptor, is fully submerged underwater. In other embodiments, a portion of at least one of the body, the first adaptor, the second adaptor, and the third adaptor, extends to a riverbed to serve as foundation for securing the module to the riverbed.

Disclosed is a zero-ascend omnispecies (ZAO) attraction system having a facility where water flows downstream, and a fish passage attraction module located downstream of the facility. In this embodiment, the module includes a body having a first end and an opposite second end, first adaptor adjacent the first end, the first adaptor having a conical structure, and second adaptor adjacent the second end, the second adaptor having a tapered structure so as to alter first flow field and second flow field adjacent the second end.

In this embodiment, the first flow field is slower than the second flow field, and the fish passage attraction module is configured to attract a variety of fish to move toward the second end of the body and upstream of the facility. In one embodiment, the first flow field of the system is closer to a central longitudinal axis than the second flow field such that greater number of fish is attracted to move toward the first flow field than the second flow field. In some embodiments, the facility capable of positioning the system includes at least one of hydropower facility, hydroelectric facility, and spillway. In other embodiments, the module is mobile and can be readily moved about anywhere downstream of the facility of the system.

In one embodiment, the body of the module of the system includes a peripheral surface between the first end and the second end, the module further including third adaptor adjacent the peripheral surface, the third adaptor configured to alter at least one of the first flow field and the second flow field, and whereby the third adaptor extends to a riverbed to serve as foundation for securing the module to the riverbed. In some embodiments, at least one of the module, the first adaptor, the second adaptor, and the third adaptor, is fully submerged underwater.

In one embodiment, a fish passage attraction module includes a floating, partially submergible body, a mooring apparatus that connects the body to a riverbed, the mooring apparatus configured to allow the body to move up and down with water elevation, and an adaptor adjacent the body, the adaptor having a tapered structure so as to alter a plurality of flow fields adjacent the body. In this embodiment, a first flow field of the plurality of flow fields is slower than a second flow field of the plurality of flow fields, and the first flow field is closer to a central longitudinal axis than the second flow field such that greater number of fish is attracted to move toward the first flow field than the second flow field.

In one embodiment, the body of the module includes a downstream end and an upstream end opposite the downstream end, where the adaptor is a first adaptor adjacent the downstream end of the body, the module further includes a second adaptor adjacent the upstream end of the body, the second adaptor having a conical structure so as to alter at least one of the first flow field and the second flow field, and whereby the structural angles of at least one of the first adaptor and the second adaptor can be adjusted.

In some embodiments, at least one of the first adaptor and the second adaptor can be switched to accommodate structures of different sizes. In other embodiments, the body includes a peripheral surface between the downstream end and the upstream end, the module further having a third adaptor adjacent the peripheral surface, the third adaptor having a geometrical structure so as to alter at least one of the first flow field and the second flow field.

In one embodiment, the module further includes a pump coupled to a portion of the body, the pump configured to alter at least one of the first flow field and the second flow field. In another embodiment, the module further includes a device coupled to a portion of the body, the device configured to attract a variety of fish.

In one embodiment, the module further includes an opening in a downstream end of the body, the opening having a horizontal bottom edge positioned below water surface, whereby the water surface is adjacent a false weir that is about one inch to about six inches above the water surface. In some embodiments, the module further includes a bottom ramp extending from the downstream end of the body, the bottom ramp configured to funnel inwardly toward the opening. In other embodiments, the module further includes a side ramp extending from the downstream end of the body, the side ramp configured to funnel inwardly toward the opening. In yet some other embodiments, the module further includes a tubular structure coupled to a portion of the body, the tubular structure configured to move fish from the opening to a different location.

In one embodiment, a fish passage attraction module includes a floating, partially submergible body having a downstream end and an upstream end opposite the downstream end, a mooring apparatus that connects the body to a riverbed, the mooring apparatus configured to allow the body to move up and down with water elevation, first adaptor adjacent the downstream end of the body, the first adaptor having first geometric structure so as to alter a plurality of flow fields adjacent the body, whereby a first flow field of the plurality of flow fields is slower than a second flow field of the plurality of flow fields, and whereby the first flow field is closer to a central longitudinal axis than the second flow field such that greater number of fish is attracted to move toward the first flow field than the second flow field, and second adaptor adjacent the upstream end of the body, the second adaptor having second geometric structure so as to alter at least one of the first flow field and the second flow field.

In one embodiment, the first geometric structure is a tapered structure, and the second geometric structure is a conical structure. In this embodiment, the structural angles of at least one of the tapered structure and the conical structure can be adjusted. Also in this embodiment, the least one of the tapered structure and the conical structure can be switched to accommodate structures of different sizes.

In one embodiment, the body includes a peripheral surface between the downstream end and the upstream end, the module further including a third adaptor adjacent the peripheral surface, the third adaptor having third geometric structure so as to alter at least one of the first flow field and the second flow field.

In some embodiments, the module further includes a pump and a device each coupled to a portion of the body, the pump configured to alter at least one of the first flow field and the second flow field, and the device configured to attract a variety of fish. In other embodiments, the module further includes an opening in the downstream end of the body, the opening having a horizontal bottom edge positioned below water surface, whereby the water surface is adjacent a false weir that is about one inch to about six inches above the water surface. In other embodiments, the module includes a bottom ramp extending from the downstream end of the body, the bottom ramp configured to funnel inwardly toward the opening, and a side ramp extending from the downstream end of the body, the side ramp configured to funnel inwardly toward the opening.

In one embodiment, a zero-ascend omnispecies (ZAO) attraction system includes a facility where water flows downstream, and a fish passage attraction module located downstream of the facility. In this embodiment, the fish passage attraction module includes a floating, partially submergible body having a first end and a second end opposite the first end, a mooring apparatus that connects the body to a riverbed of the facility, the mooring apparatus configured to allow the body to move up and down with water elevation, first adaptor adjacent the first end of the body, the first adaptor having first geometric structure so as to alter a plurality of flow fields adjacent the body, whereby a first flow field of the plurality of flow fields is slower than a second flow field of the plurality of flow fields, and whereby the first flow field is closer to a central longitudinal axis than the second flow field such that greater number of fish is attracted to move toward the first flow field than the second flow field, and second adaptor adjacent the second end of the body, the second adaptor having second geometric structure so as to alter at least one of the first flow field and the second flow field.

In some embodiments, the facility is at least one of hydropower facility, hydroelectric facility, and spillway. In other embodiments, the module is mobile and can be readily moved about anywhere downstream of the facility. In one embodiment, the facility is a hydropower facility and the module is positioned in a tailrace at a location in or near turbine outflow of the facility.

In one embodiment, the body of the module includes a peripheral surface between the first end and the second end, the module further having third adaptor adjacent the peripheral surface, the third adaptor configured to alter at least one of the first flow field and the second flow field.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

The invention will be more fully understood by reference to the detailed description, in conjunction with the following figures.

FIG. 6B is the result of pile lateral deformation analysis according to FIG. 6A.

FIG. 7C shows the results of the volumes and dimensions of gravity anchor that may be necessary for various riverbed soil types.

DETAILED DESCRIPTION OF THE INVENTION

Figure 1A:
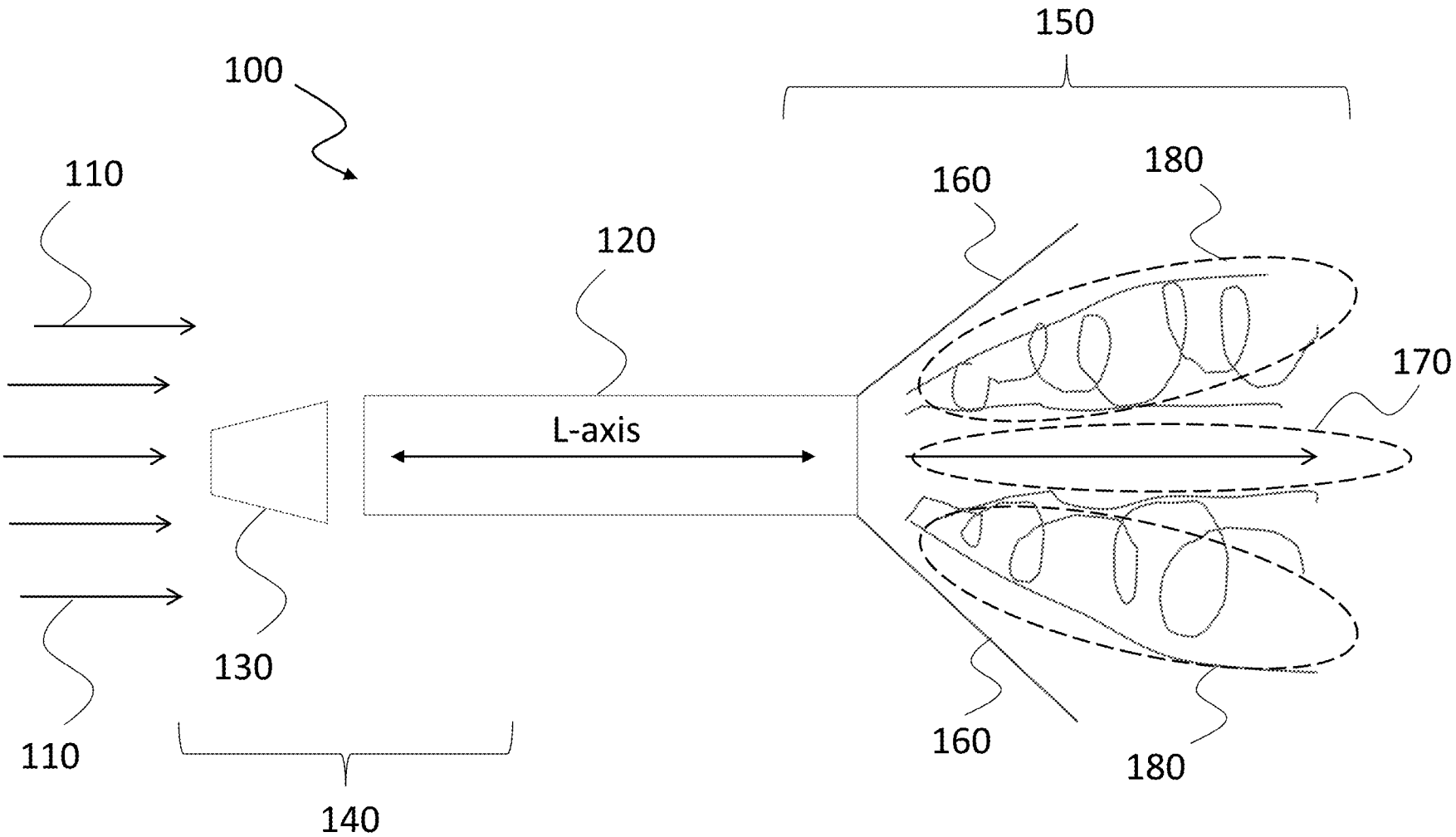
FIG. 1A is a fish passage attraction module according to an embodiment.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

The invention is a fish passage attraction system that is prefabricated and consists of a kit of standardized parts that can be assembled at a hydropower facility to attract a variety of fish to a fishway to then pass them upstream over a dam or barrier. In a preferred embodiment of the invention, it is used with a fishway that uses no ladder or mechanism that requires fish to climb, thus it is called zero ascend. As a result of this characteristic, it is able to accommodate a wider range of species, hence the reference to "omnispecies"—thus zero ascend omnispecies attraction system (ZAO-Attractor™).

ZAO-Attractor specifically pertains to the design and mechanics of redirecting the outflow from the hydropower generators or spillways for fish attraction rather than having the outflow compete with the fish attraction, and to the vessel design that creates an attractor flow pattern that separates the attraction flow from the fishway entry flow.

Migrating fish come in a whole host of sizes, with different migratory triggers and varying degrees of swimming and jumping abilities. The common denominator among all upstream migrating fish is that they are driven to swim toward or into the flow, as the flow communicates the direction for upstream. So, we know the direction they want to travel and where they want to go. ZAO-Attractor system places a large dimension obstruction in the tailrace, which the river flow and hydropower generation outflow is forced to route around. The velocity of the flow will be substantial down the sides of the ZAO-Attractor "vessel," but the water will be relatively calm on the downstream side. The placement of the module will create a flow velocity gradient downstream of its position, which is fast at the width of the module and decreasing from both sides toward the middle.

Fish swim upstream through a whole range of optimal and suboptimal conditions. Encountering low flow, low volume and vertical challenges is part of what it is to travel upriver. Fish use natural disrupters to the flow and leverage vortex effects to facilitate passage over heights or around high flow regions. This is exactly what is going on with the attraction lane and entrance in the present disclosure. Unlike asking the fish to repeatedly swim through large flows and over feet upon feet of vertical climb, the presently disclosed modules control the tailrace flows to encourages fish to swim toward the entrance which they can easily burst swim over in about a second to enter the fishway or fish transport system.

Figure 1B:
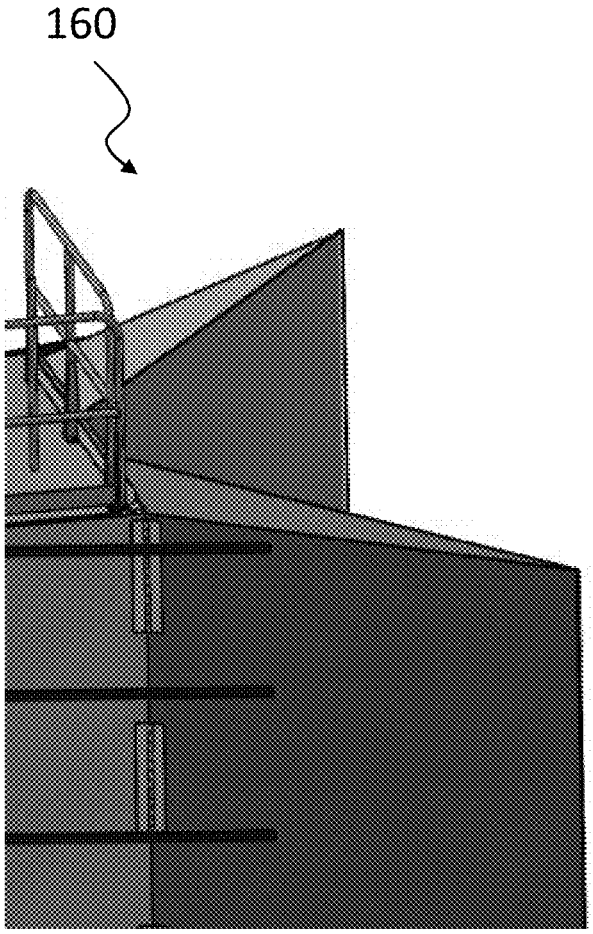
FIG. 1B shows perspective view of an adaptor configuration of a module.

Disclosed is a fish passage attraction module 100 that can be positioned in a facility according to an embodiment of the present disclosure as best illustrated in FIGS. 1A-1B. As shown, the module 100 includes a body 120 having a substantially rectangular structure although it is understood that the body 120 can take on any polygonal shape (e.g., square, trapezoidal, octagonal). In one embodiment, the dimension of the body 120 can be about 40 feet long by about 8 feet wide by about 9.5 feet tall. However, it is understood that the body 120 can be configured to any dimension in view of the size of the facility, or that the facility can accommodate multiple modules 100. In some embodiments, the facility may be a hydropower facility, a hydroelectric facility, or a spillway, among other suitable waterways or fishways.

As shown, the module 100 includes an upstream end 140 and an opposite downstream end 150 such that water flowing downstream 110 of the facility initially comes in contact with the upstream end 140 of the module 100 before flowing toward the downstream end 150 of the module 100. In other words, the primary flow direction of the facility is from left to right as illustrated by arrows 110. For example, a facility having a tailrace velocity of about 2.5 m/s (8.2 fps) can be associated with a discharge in the range of from about 11.3 to about 14.2 m^3/s (~400-500 cfs).

Adjacent the downstream end 150 of the module 100 is an adaptor 160, the adaptor 160 having tapered profiles as shown in FIG. 1B. In operation, water can flow within or through the module 100 about a central longitudinal axis (L-axis). Alternatively, water can flow adjacent of or outside of the module 100 whereby water flow paths are substantially parallel with but offset from the L-axis. In other words, there can be a plurality of water flow paths within or around the module 100, the water flow paths following the primary flow direction of the facility.

While a surface of the body 120 adjacent the adaptor 160 is shown to be substantially open as shown in FIG. 1B, it is understood that this surface of the body 120 can also be partially or completely sealed. In some embodiments (not illustrated), the surface of the body 120 adjacent the adaptor 160 can also include other suitable configurations and designs (e.g., slots, openings).

In operation, flow rates of water flow fields closer to the central L-axis may be slower and/or finer than flow rates of water flow fields further away from the central L-axis. These are best illustrated by the water flow fields 170, 180 about the downstream end 150 of the module 100. As shown, water flow fields 170 that are closer about the central L-axis may be slower in speed, velocity or force and exit along the substantially similar longitudinal direction, whereas water flow fields 180 that are further away from the central L-axis may be greater in speed, velocity or force and their exits being more randomized or with greater disturbances. Water flow fields 170 closer to the central L-axis may be considered "fine" attraction flow lanes while water flow fields 180 further away from the central L-axis may be considered "coarse" attraction flow zones. Fishes swimming upstream into the flow fields 170, 180 will travel the edge of the flow velocity they are most comfortable swimming in, the range of which will be found behind the downstream end 150 of the module 100. Therefore, the module 100 is capable of directing or attracting fishes toward the flow fields 170, 180 adjacent the module 100 whereby greater number of fishes are attracted to move toward the "fine" attraction flow lanes 170 than the "coarse" attraction flow zones 180. In some embodiments, shortening the length of the body 120 may help to increase the velocities in the coarse attraction flow lanes 180.

In one embodiment, the module 100 may include another adaptor 130 structure about an upstream end 140 of the module 100. The adaptor 130 may be substantially adjacent the front end 140 of the body 120 being conical in shape. Like the adaptor 160 adjacent the downstream end 150, the adaptor 130 adjacent the upstream end 140 can also take on other polygonal shapes (e.g., cylindrical, spherical). In operation, like the downstream adaptor 160, the upstream adaptor 130 is capable of altering flow fields about the body 120 as well as the module 100 such that the alteration is capable of altering the downstream flow fields 170, 180 thereby affecting the direction or attraction of the number of fishes moving toward the flow lanes/zones 170, 180.

In one embodiment, portions of the body 120 or the adaptors 130, 160 may be underwater. In another embodiment, all of the body 120 and the adaptors 130, 160 may be underwater. For example, some or all of these elements, may be submerged by a distance of about 0.5 m below the water surface, or about 1 meter below the water surface, or greater than about 1.5 meters below the water surface. The amount of submersion may also impact the water flow fields 170, 180 of the module 100 and consequently the attraction of the fishes.

Figure 2:
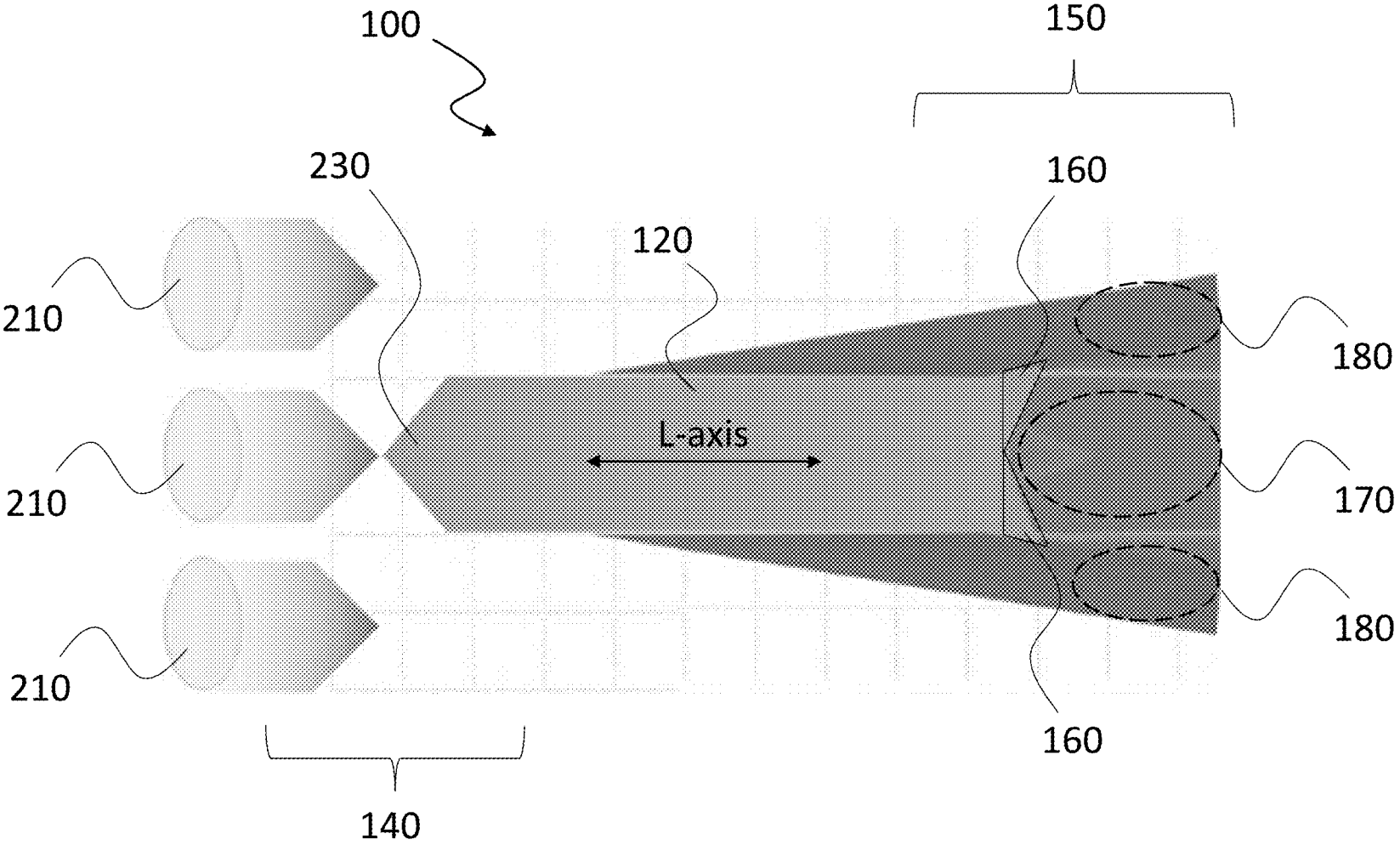
FIG. 2 is a fish passage attraction module according to an embodiment.

Reference is now made to FIG. 2 illustrating a fish passage attraction module 100 that can be positioned in a facility according to another embodiment of the present disclosure. As shown, the module 100 is substantially similar to that shown in FIGS. 1A-1B including a body 120, an upstream end 140, and a downstream end 150. In this embodiment, water within the facility is coming from primarily draft tubes 210, with the primary flow direction of the facility also from left to right. Like above, the fish passage attraction module 100 includes a downstream adaptor 160 and an upstream adaptor 230 capable of manipulating flow fields 170, 180 about the downstream end 150. Unlike above, however, the upstream adaptor 230 can be integrated as part of the body 120 of the module 100. In some embodiments, a ventri-type draft tube adaptor 230 can be placed between the draft tube 210 discharge and upstream of the module 100 to increase the speed of the flow against the module 100.

In one embodiment, the disclosed modules 100 may be located in the tailwater of a hydroelectric facility to function as a vessel that houses fish passageway or fish transport elements. In other words, the modules 100 are capable of creating fine attraction flow lanes 170 about central longitudinal axes (L-axes) of the modules 100 for attracting various species of fish. The modules 100 may create the perception of a false weir at a water surface of the facility.

In some embodiments, the modules 100 may create hydraulic signals that are strong enough so as to attract a variety of species to the entrance while guiding and fencing them toward a central attraction lane 170 and entry into the downstream face of the module 100. In other words, the entrance is adjacent the downstream end 150 of the modules 100 such that fishes are guided toward the attraction lanes 170 and ultimately into the modules 100. Once inside the modules 100, the fishes may move on its own or be transported toward the upstream end 140 of the modules 100 and ultimately upstream of the facility.

As discussed and shown above in FIGS. 1 and 2, attraction flows are taken from the space and time turbulent flow field 170, 180 in the tailwater and the hydraulics (e.g. flow, velocity, depth) of the tailwater can be shaped by the size, shape, and location of the body 120 of the module 100 as well as by adaptors 130, 160 that are shaped and attached to or placed near the body 120 to adjust the flow from the tailwater (e.g., primarily draft tube discharge 210) and flow around or through the module 100.

In some embodiments, disclosed modules 100 are designed to create hydraulic conditions to attract American Shad and river herring to the entrance thereof. Some of the critical pieces of hydraulic information in the design of a fish passage attraction module 100 include flow circulation patterns above, below, and adjacent to the fishway site and water surface elevations across the range of operating flows identified in the hydrologic analysis. Accordingly, a key component of the disclosed module 100 is the ability to adapt to water surface elevation such that changes in water elevation do not alter the operation and effectiveness of the modules 100. Characteristics of the attraction flow needed to guide fish to the entrance of the modules 100 are also critical.

Turbine outflows located near upstream fish passage systems generally create disruptive flow patterns that compete with fishway attraction flows, which typically require augmentation from an auxiliary water system. These fishway and auxiliary water system flows are drawn directly from the head pond, bypassing the hydropower generating units. An approach for determining adequate attraction flows at hydropower facilities expresses fish passage attraction flow as a percentage of the sum of the competing flows, often simplified as a percentage of the powerhouse capacity. It is recommended that fishways be designed for a minimum attraction flow per fishway equal to 5% of the total station hydraulic capacity or a flow of 50 cfs, whichever is greater.

This fish passage attraction flow can be defined based upon the production and impact to hydropower and not necessarily addressing target fish behavior and swim capability considerations. Competing flows found in the vicinity of traditional fish passage entry locations, often dam-adjacent on one side of the tailrace, can make site-specific optimization of attraction flows for fish challenging. Such competing flows can potentially be disregarded here as the disclosed modules 100 redirect and modulate the dam outflows to serve as the attraction flow to the entrance positioned downstream in the tailrace.

The combined discharge of the fishway and auxiliary water system should create an attraction jet that migrating fish will sense as they approach the entrance. In general, the design should minimize the impacts of competing flows (e.g., turbine boil, spill) on the direction, magnitude, and coherence of the attraction jet to ensure its hydraulic signal reaches as far downstream (from the entrance) as possible.

It may be critical that the fishway entrance focuses flow into a jet of higher velocity water that cleanly penetrates the tailwater and attracts fish. Accordingly, fishway entrance design is a balance between attraction velocity and maximum head for the fish to swim against. Disclosed modules 100 seek to redirect and modulate the turbine outflow to use it as the downstream attraction flow guiding the fish to the entrance located at the downstream side. As the fish passage system having a fishway module 100 does not require flow to transport fish, only a minimal entrance head is required for fish entrance over a false weir. The modulated turbine outflow serves entirely as attraction flow and is independent of the fish passage entrance flow.

Figure 3A:
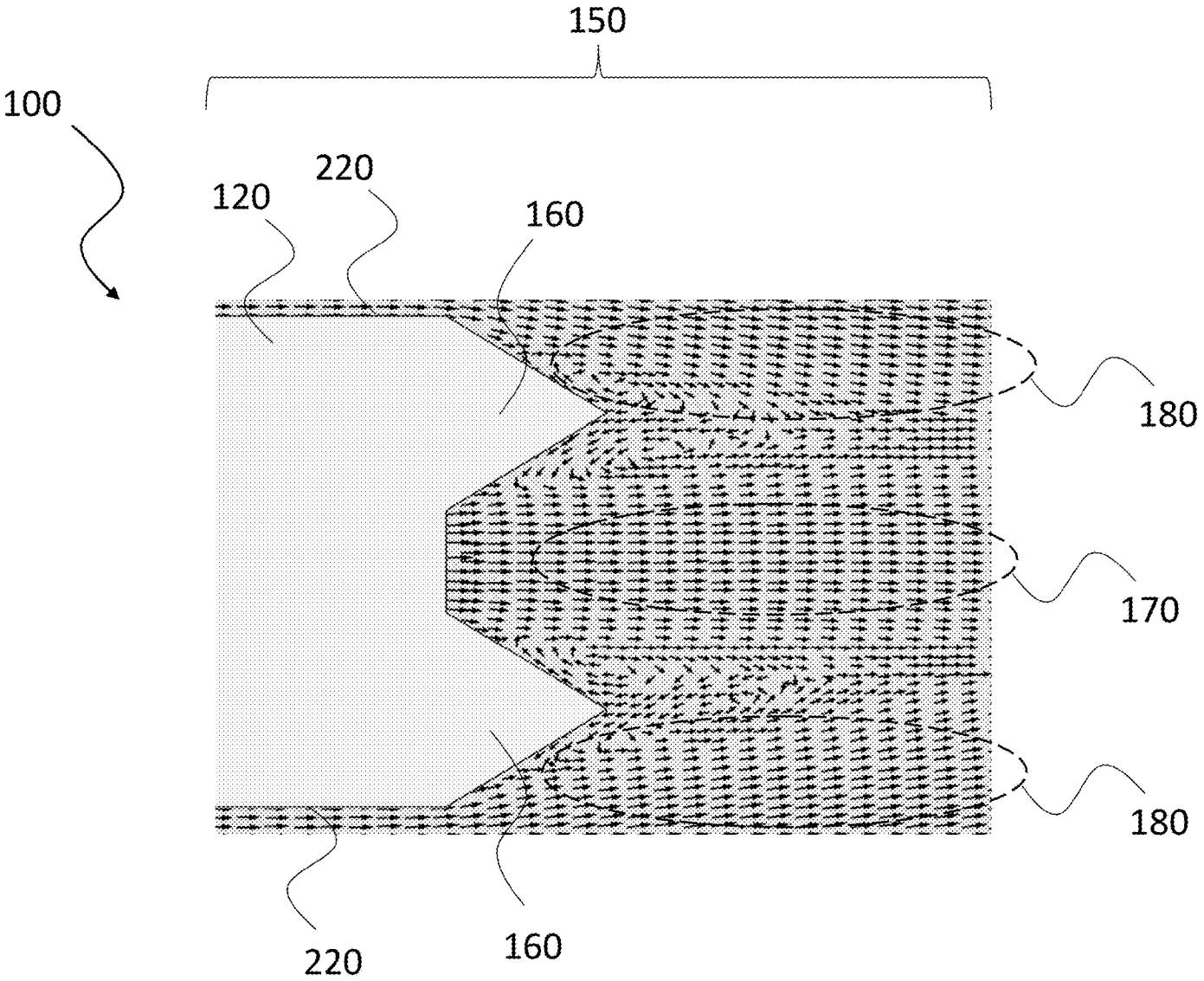
FIG. 3A is a downstream end of a fish passage attraction module according to an embodiment.

Reference is now made to FIG. 3A illustrating the downstream end 150 of a fish passage attraction module 100 according to one embodiment of the present disclosure. As shown, the module 100 is substantially similar to those shown in FIGS. 1 and 2, the module 100 having a body 120 with downstream adaptors 160. In this embodiment, the downstream adaptors 160 may be substantially triangular in structure and integrated with the body 120 of the module 100.

In one embodiment, the body 120 further includes peripheral surfaces 220 between the upstream end 140 (to the left of the figure) and the downstream end 150. As discussed above, the body 120 may be substantially rectangular in shape. Accordingly, there may be four peripheral surfaces 220 (only two are shown as FIG. 3 is a top-down view) between the upstream end 140 and the downstream end 150. It will be understood that there may be fewer or more peripheral surfaces 220 depending on the structure of the body 120 (e.g., triangular, pentagonal).

In one embodiment, one or more adaptors (not shown) may be coupled to (e.g., integrated or mechanically secured) the peripheral surfaces 220 of the body 120 similar to the adaptors 130, 160, 230 shown and discussed above. These one or more side-wing adaptors (or top and bottom adaptors) adjacent the peripheral surfaces 220 of the body 120 may create a wake region of eddies and disturbed water that although not the highest speed is expected to act as a fence to discourage fish from crossing over it once they are in the central zone. It will be understood that the peripheral adaptors (e.g., top, bottom and the two sides of the body 120) can take on a variety of geometric structures similar to those describe above for upstream and downstream adaptors 130, 160, 230. In addition, the peripheral adaptors are able to influence the water flow fields 170, 180 near the downstream end 150 of the module 100.

In this embodiment, corner eddies within the flow fields 180 may be smoothed out by downstream adaptors 160 to control the amount of turbulence in that area so that fish are attracted to the entry in the center flow fields 170 and discouraged from going around the module 100. In this embodiment, the center flow fields 170 are also influenced by the use of a rounded upstream nose adaptor (not shown).

Figure 3B:
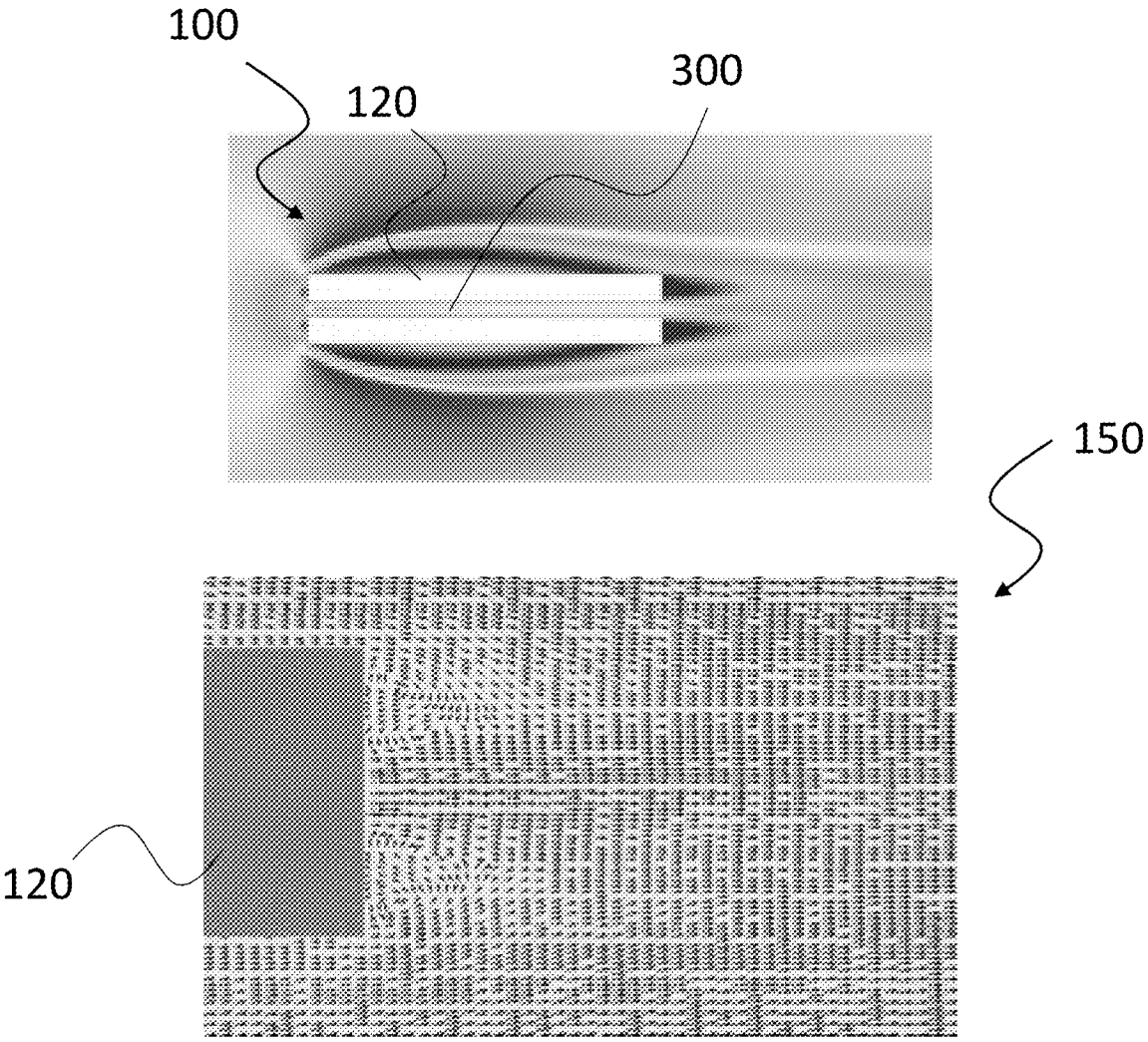
FIG. 3B shows perspective and downstream end views of a fish passage attraction module according to an embodiment.

In the alternative, eddies in the central region of the flow 170 may be eliminated or minimized by including a flow through pipe or tube 300 as best illustrated in FIG. 3B. The flow through pipe or tube 300 runs from the module 100 and has an upstream opening that is fed with upstream tailwater that flows through the tube and exits the downstream end of the module 100. For example, the flow through pipe or tube 300 can be disposed about a center portion of the body 120 having a dimension that is approximately 20 inches square. Like the peripheral adaptors, the central tube 300 is also able to influence the water flow fields 170, 180 near the downstream end 150 of the module 100.

In some embodiments, eddies or wakes from eddies can be projected further downstream by using a series of downstream adaptors 160. In these embodiments, the adaptors 160 need not be attached or connected to the body 120 of the module 100 but instead may be connected with an all-thread bar (not shown) to the body 120 of the module 100. The distance and angle of orientation of these "coupled" adaptors may be dynamically controlled to produce the desired turbulence. In other embodiments, the adaptors may be individual paddles (not shown) that are coupled to the module 100 via the bar as discussed above. The individual paddles may be hydrofoil shaped with a rubber and attached with a mooring line to the module 100 to maintain their position through hydrodynamic control.

The embodiments disclosed in FIGS. 3A-3B demonstrate the use of surfaces to modify flow conditions thereby changing the speed (e.g., slower or faster) and structure (e.g., laminar, swirls, eddies) to create regions of flowing water 180 on either side of a central flow lane 170 that attracts fish and that fences them in once they arrive at the central flow lane 170.

Figure 4:
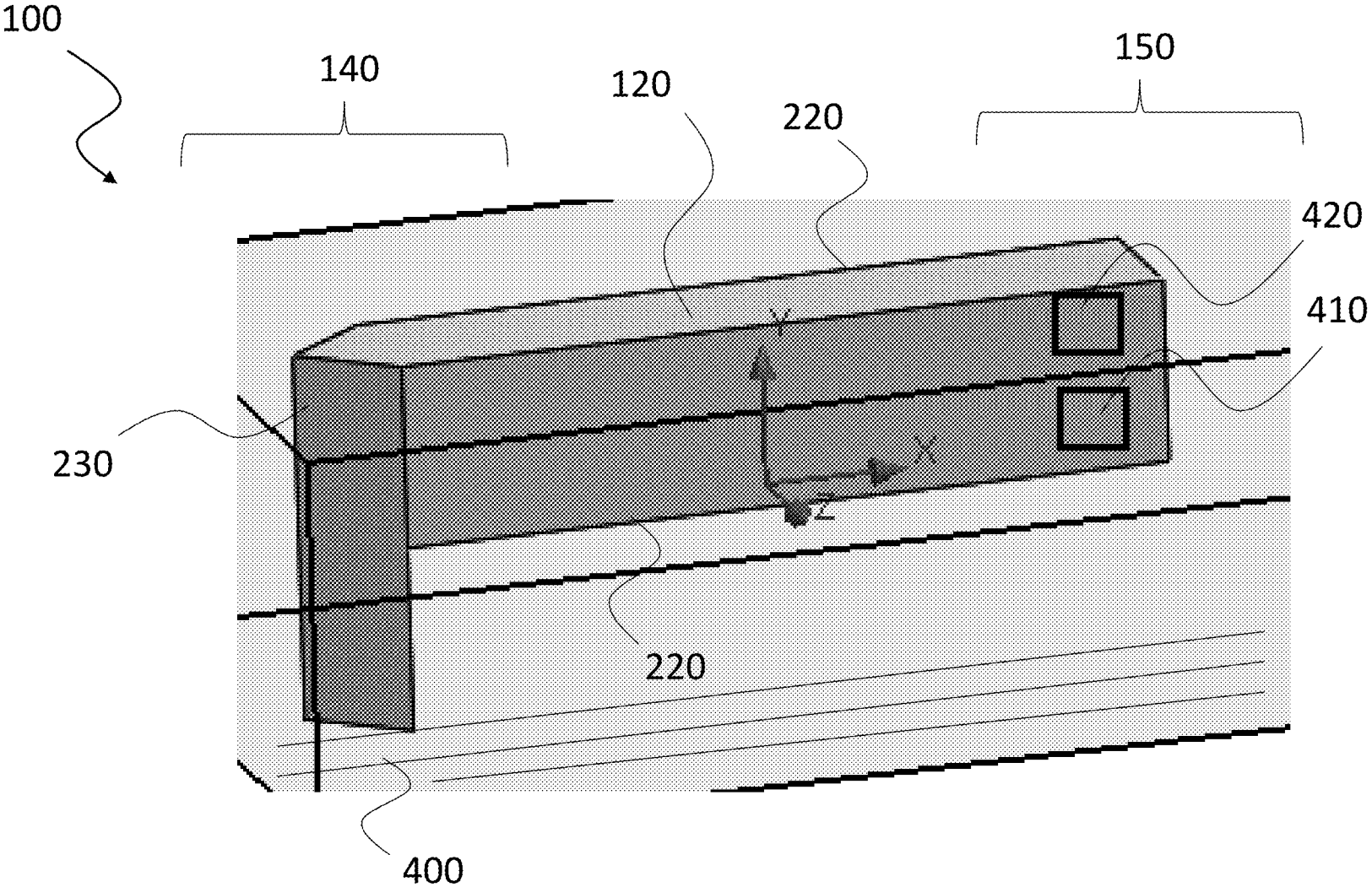
FIG. 4 is a perspective view of a fish passage attraction module according to an embodiment.

Reference is now made to FIG. 4 illustrating a fish passage attraction module 100 according to another embodiment of the present disclosure. As shown, the module 100 is substantially similar to those shown above having a body 120 with an upstream adaptor 230. In this embodiment, the upstream adaptor 230 is a triangular cone (e.g., pointed nose) and integrated with the body 120 of the module 100 although other geometric structures can be implemented. In some embodiments, an upstream adaptor 230 with a pointed nose may result in slightly higher maximum velocity than an upstream adaptor 230 with a blunted nose. The higher maximum velocity may extend further downstream 150 and eliminate swirling eddies along the side flow fields 180.

In an embodiment, extending the pointed nose of the upstream adaptor 230 below the bottom peripheral surface of the body 120 can increase the maximum velocity slightly resulting in a more v-shaped central flow field 170. In one embodiment, the upstream adaptor 230 can extend about 0.5 meter below the water surface. In another embodiment, the upstream adaptor 230 can extend about 1.0 meter below the water surface. In yet another embodiment, the upstream adaptor 230 can extend greater than about 1.5 meters below the water surface. The lower the upstream adaptor 230 extends underneath the water surface, the more prominent is the v-shaped central flow field 170 near the downstream end 150 of the module 100.

As shown, the upstream adaptor 230 can extend vertically to a riverbed 400 to serve as foundation for securing the module 100 to the riverbed 400. In other words, the upstream adaptor 230 physically extends past the bottom peripheral surface of the body 120 as well as the module 100 itself and is the lowest extending structure of the module 100. Similarly, while not shown, portions of the body 120 or the adaptors 130, 160, 230 (including peripheral adaptors) can extend to the riverbed 400 to serve as foundation in securing the module 100 as deployed in the facility.

In short, adaptors 130, 160, 230 attached to the body 120 of the module 100, whether upstream, downstream, or on peripheral sides including top and bottom, can help to facilitate and dynamically maintain the fish attraction lanes 170, 180. In some embodiments, as best illustrated in FIG. 4, one or more of these various adaptors 130, 160, 230, including any portion of the body 120, can extend vertically to a depth below the bottom-most peripheral surface of the body 120 and the module 100 all the way to the riverbed 400 to serve as foundation or anchor.

In some embodiments, at least a portion of at least one of the body 120 and the plurality of adaptors 130, 160, 230 can be underwater. In other embodiments, at least one of the body 120 and the plurality of adaptors 130, 160, 230 can be fully submerged underwater.

In one embodiment, a pump 410 may be included inside a portion of the body 120. The pump 410 can be configured to alter water flow fields adjacent the body 120. While the pump 410 is shown to be near the downstream end 150 and inside of the body 120, the pump 410 can also be located near the upstream end 140 and outside of the body 120, or adjacent peripheral surfaces 220 of the body 120. The pump 410 can be electrically powered (with battery or via solar cells) to facilitate adjustment of the downstream flow fields 170, 180 as necessary. In one embodiment, the pump 410 may be a solar-powered variable speed pump using water from the tailrace so as to not compromise any of the facility's power generation.

In one embodiment, the module 100 may further include a device 420 coupled to a portion of the body 120. The device 420 may be coupled to the body 120 and powered with power supplies similar to those for the pump 410. Similarly, the device 420 can be located anywhere throughout the body 120 similar to that of the pump 410. In one embodiment, the device 420 and the pump 410 may be integrated as a single unit.

In operation, the device 420 can be configured to attract a variety of fish toward the downstream end 150 of the module 100. For example, the device 420 may be lights, acoustics and/or bubbles as part of a guidance system to attract or discourage fish entry into an area. In some embodiments, flow surfaces can be combined with bubbles, acoustics and/or lights to achieve the desired attraction and guidance. The migrating habits of fish are light sensitive. With respect to American Shad spawning adults are reported to ascend between 0900 and 1600 hours. Strobe lights have been used to cause a strong, consistent and sustained avoidance response by juvenile American Shad. Similarly, migrating American Shad may also be sensitive to sound pressure levels. High sound pressure levels ultrasounds (e.g., 125 kHz) have been indicated as part of a strategy to guide them away from powerhouse intakes.

In operation, the velocity of the jet and quantity of attraction flow must produce enough momentum to project into the tailwater to a point where fish are commonly present. This will create the opportunity for fish to detect the hydraulic cue created by the jet (e.g., flow fields 170, 180). Redirecting the outflow around the module 100 creates two high velocity streams on either side of the module structure (e.g., body 120) that extend downstream and radiate laterally, while the module 100 itself creates a calm water lane directly behind 170 and back end (e.g., downstream end 150) of the module 100, produces the hydraulic cues to funnel the fish toward the entrance of the module 100 (e.g., where the fish enters the module 100 near the downstream end 150 thereof). The fish will encounter these cues as they swim upstream, before they fully enter the tailrace and potentially encounter competing and/or confusing flows.

Described herein are characteristics of the coarse attraction flow 180 and the pair of high velocity streams (not shown) that can be created on either side 220 of the module 100. The streams are expected to be of equal velocity and mirror images of each other separated initially by the width of the module 100. The velocity jets will push downstream, however, they will also radiate out. If one considers the wake of a boat as an analogy, the peak velocity stream is at the middle, visible, in this analogy, as the crest of the wake, the fastest water, and the further away from the crest, on either side of the crest, the slower the velocity stream becomes while still moving downstream.

Migrating fish will find the velocity stream speed that is both attractive and comfortable to swim through. Ideally, the "crest velocity" will slightly exceed that speed creating a jet stream fence that directs the fish toward the fish passage system entrance at the apex of the funnel created by the two velocity streams. In some instances, it is recommended that the entrance jet velocity (measured at the entrance) be within a range of 4 to 6 fps at any site where river herring are present. If only the stronger swimming Atlantic salmon and American shad are present, then an entrance jet velocity of 6 to 8 fps is permissible. In some embodiments, it may be desirable to target the jet velocity crest of the coarse flow fields 180 in the disclosed modules 100 to a velocity just beyond the swim speed range of the target species. Given the two target species, American Shad and river herring, the crest jet flow proposed target velocity at the downstream end 150 of the module 100 is about 8 fps.

Regarding locating the entrance of a traditional fishway, it is generally advisable to locate it immediately downstream of the barrier (e.g., dam) and adjacent to the dominant source of far field attraction flow (e.g., powerhouse discharge, spillway). Fish will swim upstream along their preferred flow velocity stream until they encounter a disruption in the flow and/or an obstruction and then they will search for an alternative flow stream to follow. Placing the traditional passage entrances close by increases the opportunity that the fish might happen on it.

Presently disclosed modules 100 are designed to extend downstream, presenting target species preferred velocity streams that will direct their path upriver and to the entrance never requiring a disruption in flow stream and searching. In some instances, excavation to create a deeper, slower, and less turbulent region at the fishway entrance and/or additional entrances may be required.

For coarse attraction flow 180, volumetric flow of a dam outflow to be redirected is likely quite large, at approximately 50 cfs, given traditional fish passage attraction flow minimums. In some embodiments, coarse attraction flow 180 may have crest jet velocity of about 8 fps to create a target fish desired velocity stream while also establishing a velocity barrier that will effectively guide the fish to the module 100. Turbulence in this coarse attraction flow region 180 is expected and may be used to guide the fish toward the central lane 170 that leads to the entrance (e.g., downstream end 150 of the module 100), and used as a fence to discourage fish from passing over the crest once they are in the central attraction lane. The coarse attraction jet velocity stream may be focused in the downstream direction, with the entire module positioned within the swim path of migrating fish. The directionality of the coarse attraction flow should help facilitate fish engagement.

In some embodiments, the fine attraction flow 170 (or entrance lane flow) may have velocity of about 1.5 fps, or as close to uniform as possible, with volumetric flow rate of about 1 cfs to about 2 cfs. Void of high turbulent and aeration zones with depth at entrance dictated by target species, fish swim down to go up, ideal depth is about two body lengths to give fish the opportunity to propel themselves via burst swim.

In some embodiments, a fish passage attraction module includes a body 120 having a downstream end 150 and an opposite upstream end 140, first adaptor 130 adjacent the upstream end 140, the first adaptor 130 having a conical structure, and second adaptor 160 adjacent the downstream end 150, the second adaptor 160 having a tapered structure so as to alter first flow field 170 and second flow field 180 adjacent the downstream end 150. In some embodiments, whether tapered structure or conical structure, the structural angles of the adaptors 130, 160 may nevertheless be adjusted. In other words, due to the modularity of the adaptors 130, 160, the angles of these structures (e.g., tapered, conical) may be readily modified as necessary when coupled to a portion of the body 120.

In one embodiment, the first flow field 170 is slower than the second flow field 180, and the first flow field 170 is closer to a central longitudinal axis (L-axis) than the second flow field 180 such that greater number of fish is attracted to move toward the first flow field 170 than the second flow field 180. Fish entering the body 120 from the downstream end 150 may subsequently move toward the upstream end 140 of the module 100.

In one embodiment, the module 100 further includes a pump 410 and a device 420 each coupled to a portion of the body 120, the pump 410 configured to alter water flow fields 170, 180 adjacent the body 120 and the device 420 configured to attract a variety of fish toward the downstream end 150 of the body 120.

In one embodiment, the body 120 of the module 100 includes a peripheral surface 220 between the downstream end 150 and the upstream end 140, the module 100 further including a third adaptor (not shown) adjacent the peripheral surface 220, the third adaptor having a geometrical structure so as to alter at least one of the first flow field 170 and the second flow field 180. In some embodiments, at least one of the body 120, the first adaptor 130, 230, the second adaptor 160, and the third adaptor, is fully submerged underwater. In other embodiments, a portion of at least one of the body 120, the first adaptor 130, 230, the second adaptor 160, and the third adaptor, extends to a riverbed 400 to serve as foundation for securing the module 100 to the riverbed 400.

In one embodiment, a zero-ascend omnispecies (ZAO) attraction system may include a facility where water flows downstream and a fish passage attraction module 100 located downstream of the facility. In this embodiment, the module 100 may be similar to those described above. For example, the module 100 may include a body 120 having a first end 140 and an opposite second end 150, first adaptor 130, 230 adjacent the first end 140, the first adaptor 130, 230 having a conical structure, and second adaptor 160 adjacent the second end 150, the second adaptor 160 having a tapered structure so as to alter first flow field 170 and second flow field 180 adjacent the second end 150. In some embodiments, the facility may be a hydropower facility, a hydroelectric facility, or a spillway, among other suitable waterways or fishways.

A facility such as a fishway without any external structures may have generally gradient flow velocity patterns. With the inclusion of a fish passage attraction module 100 in accordance with the present disclosure, the flow fields 170, 180 in the facility may be altered (e.g., the flow field 170 may appear as recesses or notches thus disrupting the gradient flow velocity patterns) such that the first flow field 170 is slower than the second flow field 180.

In some embodiments, the adaptors 130, 230, 160 around the module 100 may be modified such that fish is attracted to move toward the first flow field 170 having velocities they are most comfortable with, while the second flow fields 180 are able to generate velocities that may serve as a fence to encourage the fish to move toward the first flow field 170 and ultimately enter the body 120 of the module 100 from the second end 150 of the body 120 and subsequently upstream of the facility. In one embodiment, the first flow field 170 of the system 500 may be closer to a central longitudinal axis (L-axis) than the second flow field 180 such that greater number of fish is attracted to move toward the first flow field 170 than the second flow field 180.

In some embodiments, the presently disclosed fish passage attraction modules 100 may be small compared to the geometry of the tailrace and the flow field of the facility, it may nevertheless make an impact and effect the flow fields. For example, the presence of the fish passage attraction module 100 may extend flow fields 170, 180 further downstream of the facility in comparison with flow fields within a facility 600 without such fish passage attraction module 100. In some embodiments, the module 100 is mobile and can be readily moved about anywhere downstream of the facility as placement of the fish passage attraction module 100 about the facility is critical. In other embodiments, the modules 100 may be placed within a facility where fish are to be expected, for example, nearby flow fields having flow velocity of about 4 fps. In yet another embodiment, the facility may be a hydropower facility and the module 100 may be positioned in a tailrace at a location in or near turbine outflow of the facility.

In one embodiment, the disclosed modules are designed to fully integrate into modular hydropower systems. Modular hydropower systems can include a variety of standardized steel frame modules that can be stacked and combined to form a complete low-head dam system. Global stability under normal, unusual, and extreme loading can be provided via a post-tensioned tie-down anchor system, as verified by engineering analysis. The structural capacity of module stacks can be designed and verified by engineering analysis to the required load and resistance factor. The presently disclosed embodiments can be structurally independent. The upstream stacks can provide structural capacity with respect to impoundment of the headwater and will also include trash racks, spillway gates, generation modules and other necessary systems. Accordingly, in some embodiments, the presently disclosed modules can be readily and fully integrated with existing modular hydropower systems.

In some embodiments, the ZAO fish passage attraction module is designed to attract and provide upstream passage for a wide range of weak and strong swimming species. By using prefabricated, modular and standardized components—produced by additive manufacturing techniques where possible—aim to achieve significant cost savings and scalability across multiple sites or facilities. In some embodiments, the presently disclosed modules and systems may be used to attract River Herring & American Shad, by eliminating the steep pass, move entrance to water surface, provide attraction flow (aspiring to be passive), and develop flow control adaptors that can be additively manufactured to site specific flows, among other improvements.

Figure 5A:
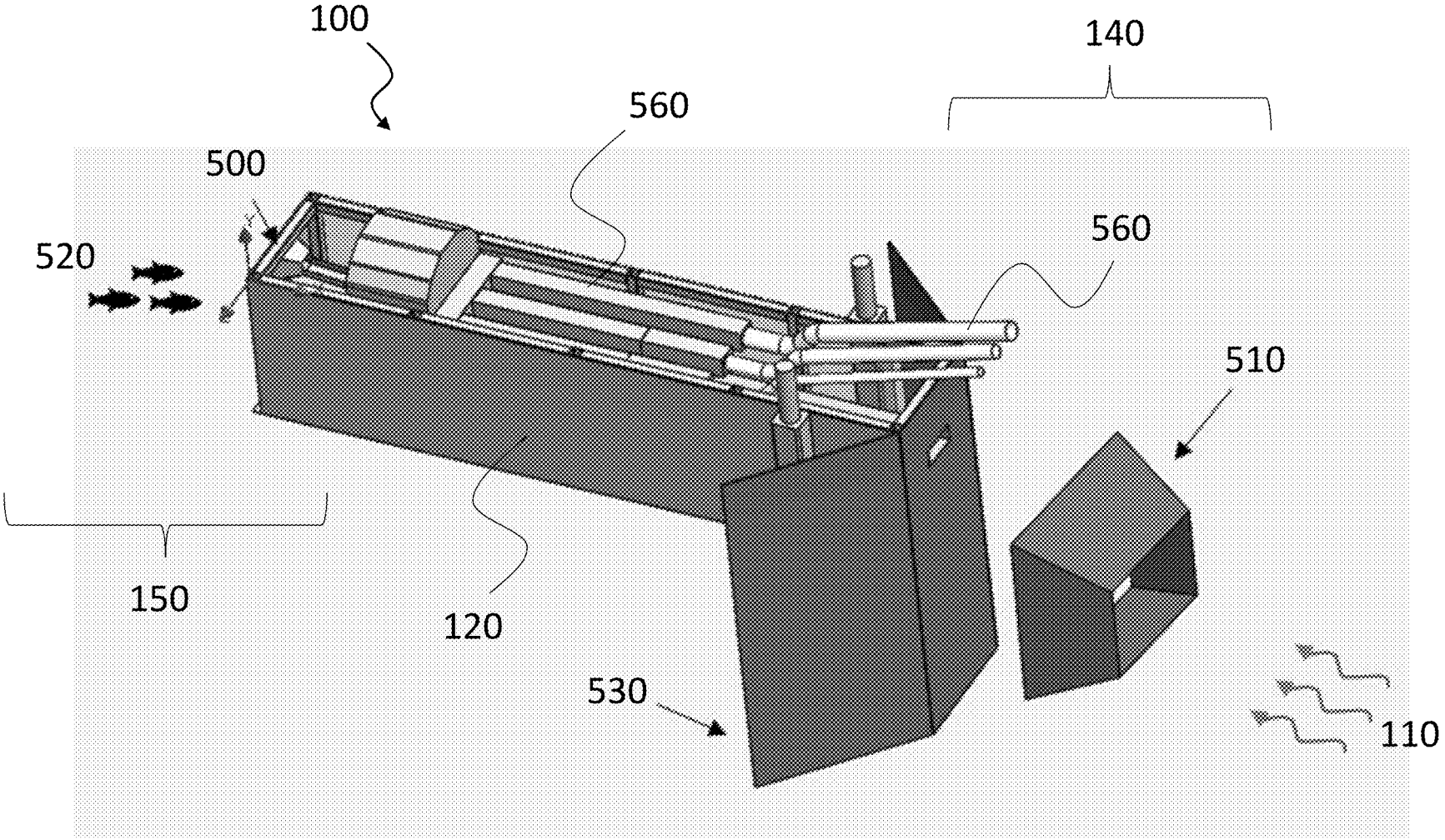
FIGS. 5A-5C are isometric, overhead and elevation views of a fish passage attraction module according to one embodiment.
Figure 5B:
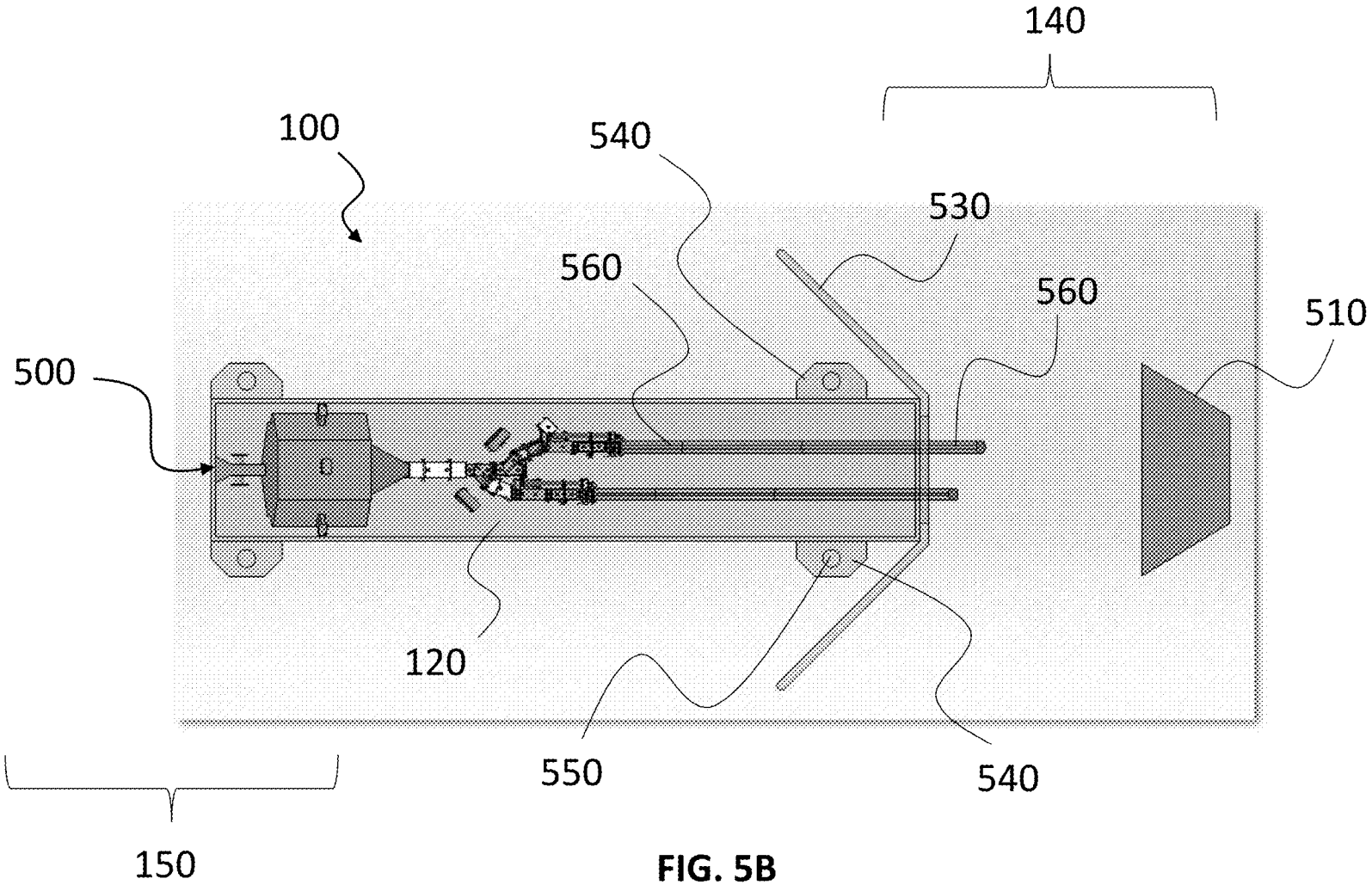
Figure 5C:
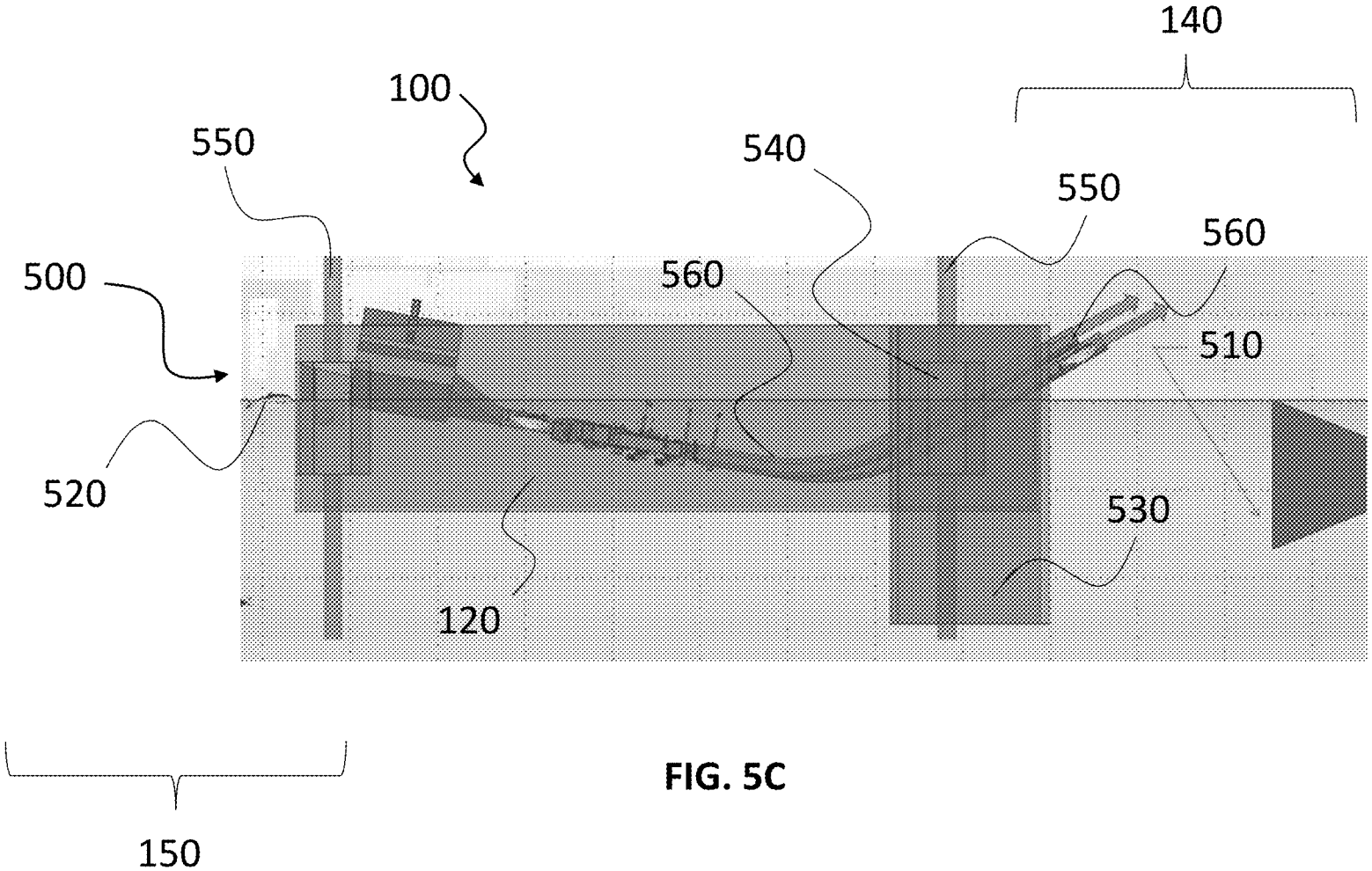

Reference is now made to FIGS. 5A-5C showing isometric, overhead and elevation views, respectively, of a fish passage attraction module 100 according to an embodiment. The fish passage attraction module 100 includes a body 120 similar to those discussed above. The module 100 is configured to be positioned in a facility and receive water flowing downstream 110 such that water initially contacts an upstream end 140 of the module 100 before flowing toward the downstream end 150 of the module 100.

In one embodiment, the module 100 includes flow adaptors 530 and a draft tube adaptor 510 adjacent the upstream end 140 of the body 120. The flow adaptors 530 may be coupled or attached to the body 120 similar to the upstream adaptors 230 described above, while the draft tube adaptor 510 may be coupled or attached to the primary draft tubes 210 in similar fashion and thus will not be elaborated further herein.

In some embodiments, at least a portion of the body 120 may be floating in the water, be partially submergible, or be completely submerged. In one embodiment, the module 100 includes a mooring apparatus having ring connectors 540 and spud poles 550. In this embodiment, while four ring connectors 540 are shown coupled to four spud poles 550, it is understood that there can be more or fewer ring connectors 540 and spud poles 550 depending on the size of the body 120 as well as the location of the body 120 positioned in the facility.

In operation, the mooring apparatus or system connects the body 120 to a riverbed, the mooring apparatus or system is configured to allow the body 120 to move up and down with water elevation. There are two types of mooring apparatus or systems that can be used with the modules 100, piles and gravity anchors, and will be described in further details in FIGS. 6 and 7, respectively.

Like above, the module 100 shown in FIGS. 5A-5C may include adaptors similar to those described above, the adaptor being adjacent the body 120. In one embodiment, the adaptor may have a tapered structure so as to alter a plurality of flow fields 170, 180 adjacent the body 120, where a first flow field 170 of the plurality of flow fields 170, 180 is slower than a second flow field 180 of the plurality of flow fields 170, 180. In another embodiment, the first flow field 170 is closer to a central longitudinal axis (L-axis) than the second flow field 180 such that greater number of fish is attracted to move toward the first flow field 170 than the second flow field 180.

In one embodiment, the module 100 includes an opening 500 adjacent the downstream end 150 of the body 120, the opening 500 adjacent the flow fields and configured to receive a variety of fish 520. In another embodiment, the module 100 further includes a tubular structure 560 coupled to a portion of the body 120. The tubular structure 560 may be positioned within the body 120 and extend from the downstream end 150 to the upstream end 140 of the module 100. In operation, the tubular structure 560 may be in fluid communication with the opening 500 such that fish 520 received within the opening 500 may be transported along the tubular structure 560 and exit out of the body 120 near the upstream end 140. In other words, the tubular structure 560 can be configured to move fish 520 from the opening 500 to a different location within the facility.

In one embodiment, the module 100 is positioned so that the entry or opening 500 is at water level and the mooring apparatus or system allows the module 100 to move up and down with water elevation. The mooring apparatus or system is able to maintain the body 120 of the module 100 at or near water level, and will be described in more details below.

Figure 6A:
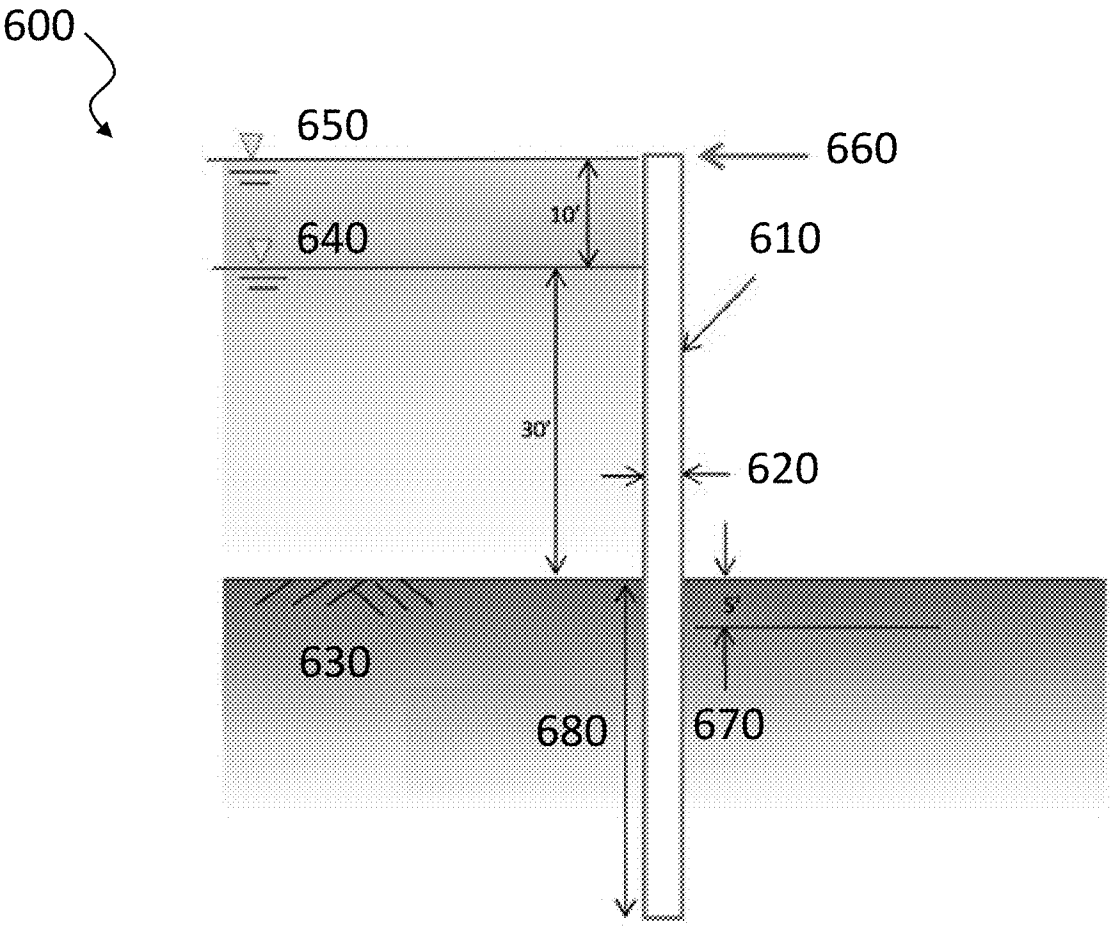
FIG. 6A is a cross-sectional view of a pile foundation for a mooring system.

Reference is now made to FIG. 6A showing a cross-sectional view of a pile foundation of a mooring apparatus or system, and FIG. 6B showing the results of pile lateral deformation analysis in accordance with FIG. 6A. As discussed above, the piles may be used as part of a mooring apparatus or system.

FIG. 6A shows a cross-sectional view of a pile foundation 600 as part of a mooring apparatus or system to be used in conjunction with presently disclosed fish passage modules 100. The pile foundation 600 includes an open pipe pile 610 having a pile diameter 620, the pipe pile 610 capable of extending by an embedment depth 680 into foundation soil 630 of a riverbed. In this embodiment, normal water level 640 (e.g., 30 feet above base of foundation soil 630) and flood water level 650 (e.g., an additional 10 feet above the normal water level 640) may be determined as shown, along with a lateral design load 660. The pile lateral deformation analysis also ignores a pre-determined depth 670 (e.g., 5 feet) from the embedment depth 680.

FIG. 6B is a summary of the pile lateral deformation analysis showing the size of pile 610 that should be used in the mooring system, which depends on the type of foundation soil 630 (e.g., granular or cohesive) as well as the number of piles 610 (e.g., four or eight) used in the mooring system. For example, a mooring system using four open pipe piles 610 each having pile diameter 620 of about 24 inches in granular soil foundation 630 may produce excessive deflection, while a mooring system using eight open pipe piles 610 each having pile diameter 620 of about 24 inches in granular soil foundation 630 may result in acceptable amount of deflection.

Figure 7A:
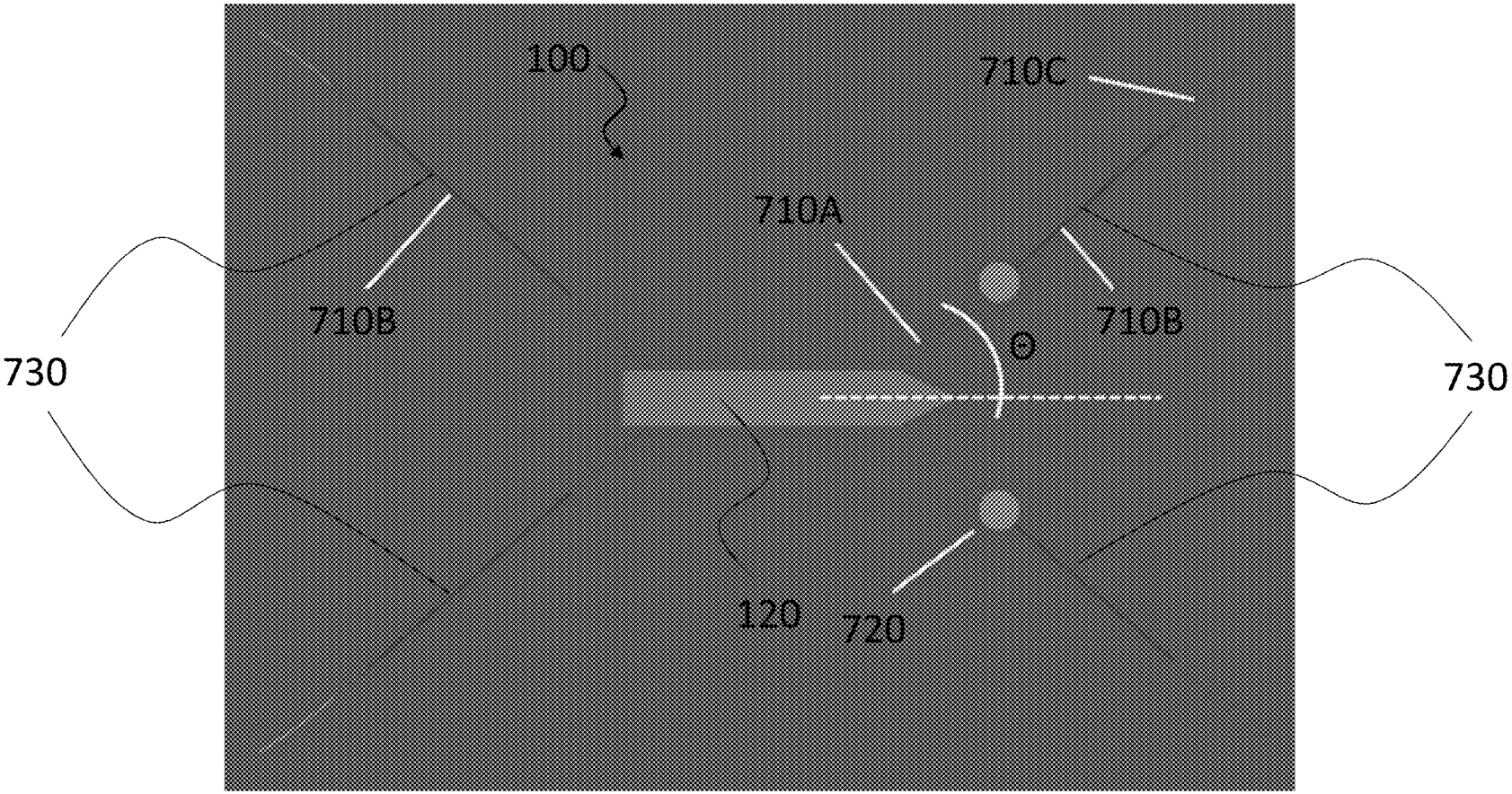
FIG. 7A is a top-down view of a mooring system having a plurality of mooring lines attached to a gravity anchor.
Figure 7B:
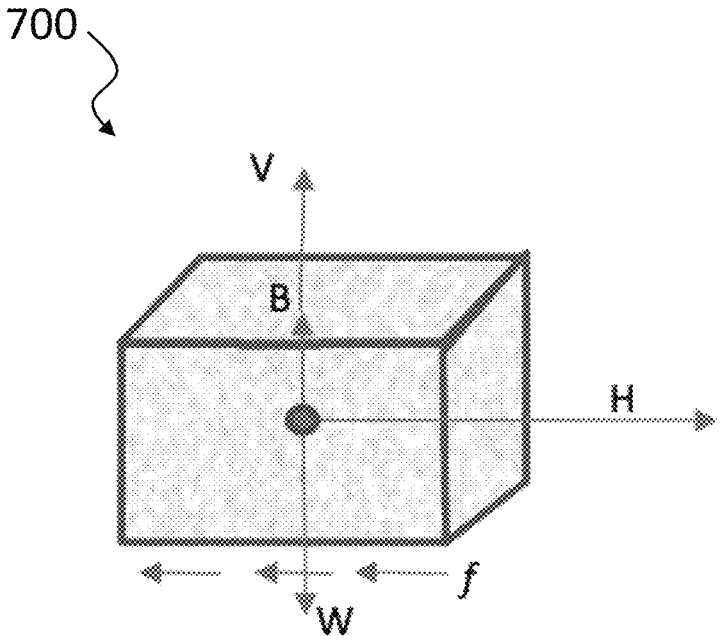
FIG. 7B is a perspective view of a gravity anchor block.

Reference is now made to FIG. 7 showing another mooring apparatus or system using gravity anchors. FIG. 7A is a top-down view of a mooring system having a plurality of mooring lines 730 attached to a gravity anchor 700, FIG. 7B is a perspective view of a gravity anchor block 700, and FIG. 7C shows the results of the volumes and dimensions of gravity anchor that may be necessary for various riverbed soil types.

As shown in FIG. 7A, the module 100 includes a floating, partially submergible body 120 which may be connected to a mooring apparatus or system using gravity anchors 700. The body 120 may be coupled to the gravity anchor 700 via a plurality of mooring lines 730. While four mooring lines 730 are shown, with each mooring line 730 at an angle (Θ) of about 40 degrees relative to the body 120, it is understood that more or fewer mooring lines 730 can be utilized.

Each mooring line 730 may include first portion 710A, second portion 710B, and third portion 710C. In one embodiment, the first portion 710A may be about 20 feet of 28 mm open link chain, the second portion 710B may be about 47 feet of 52 mm polyester (e.g., 3:1 scope on all lines), and the third portion 710C may be about 23 feet of 28 mm open link chain. In another embodiment, the mooring line 730 may include a float 720 (e.g., 1.8 $m^3$). It will be appreciated that various types and configurations of mooring line 730 may be utilized as part of the mooring apparatus or system for the fish passage module 100.

As discussed above, a gravity anchor block 700 can be attached at the end of a mooring line 730 and deployed as part of foundation for securing the module 100 to the riverbed. FIG. 7B shows the types of forces exerted on and around the gravity anchor block 700. As illustrated, the gravity anchor block 700 includes an anchor self-weight (W) with an interface friction (f) relative to the riverbed foundation. The gravity anchor block 700 will be subjected to vertical upward force (V) and horizontal lateral force (H) from the mooring line 730, along with a buoyancy force (B). FIG. 7C shows the summary of analyzing various scenarios of gravity anchor blocks 700 and the various volumes and dimensions required depending on riverbed soil types.

Figure 8B:
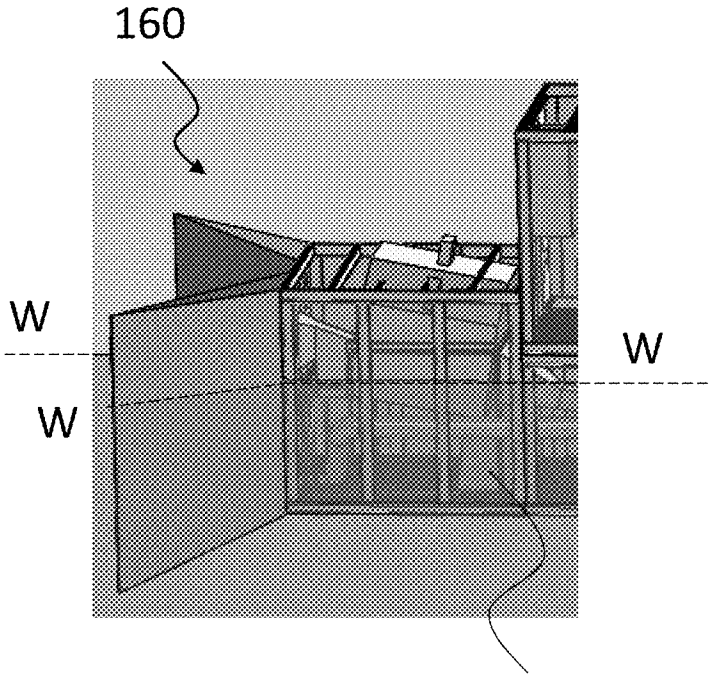
FIGS. 8A-8B are adaptor structures with different sizes.
Figure 8A:
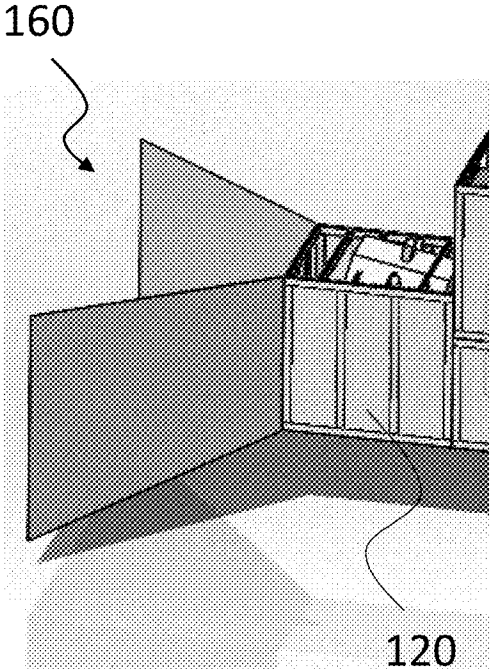

Reference is now made to FIGS. 8A-8B showing a module body 120 having adaptor structures 160 of different sizes. As shown, the downstream adaptor 160 in FIG. 8A is a fin-like structure that is substantially larger than the downstream adaptor 160 in FIG. 8B which shows a fin-like structure that is relatively smaller. In one embodiment, the latter figure further illustrates the partially submergibility of the modular body 120, where the water line is illustrated by the W-W dashed lines.

In some embodiments, the adaptors 160 are modular and interchangeable. In other words, the adaptors 160 can be readily removed or switched from the body 120 to accommodate structures of different sizes (e.g., switching from larger structure to smaller structure, or vice versa) and/or dimensions (e.g., switching from tapered structure to conical structure, or vice versa). Similarly, while only downstream adaptors 160 are shown, it is understood that the same modular and interchangeability applies to upstream adaptors 130, 230. In other words, the upstream adaptors 130, 230 may be modular and interchangeable such that structures of different sizes and/or dimensions can be switched or swapped out.

Figure 9A:
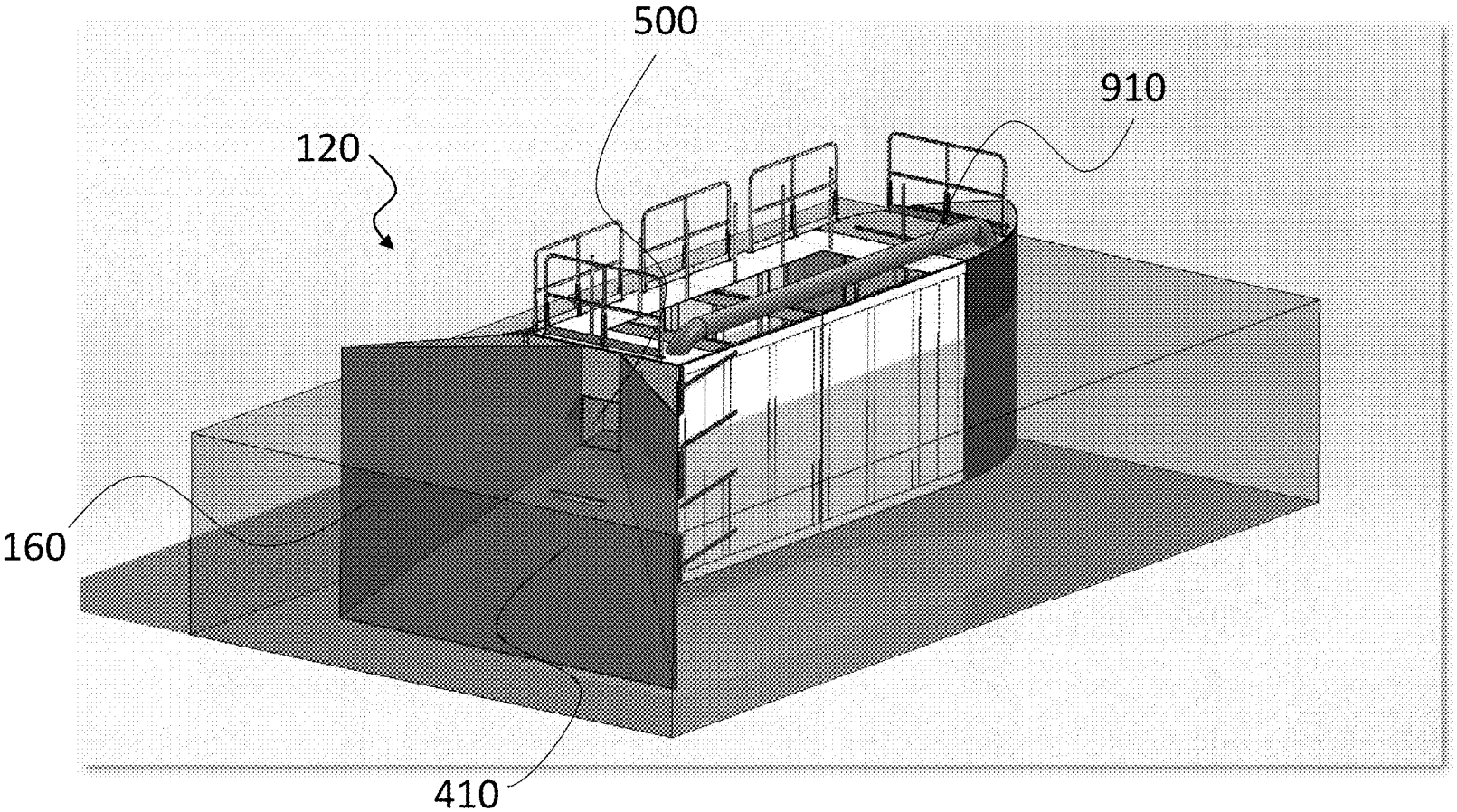
FIG. 9A-9B are perspective and side views of a fish passage attraction module according to an embodiment.
Figure 9B:
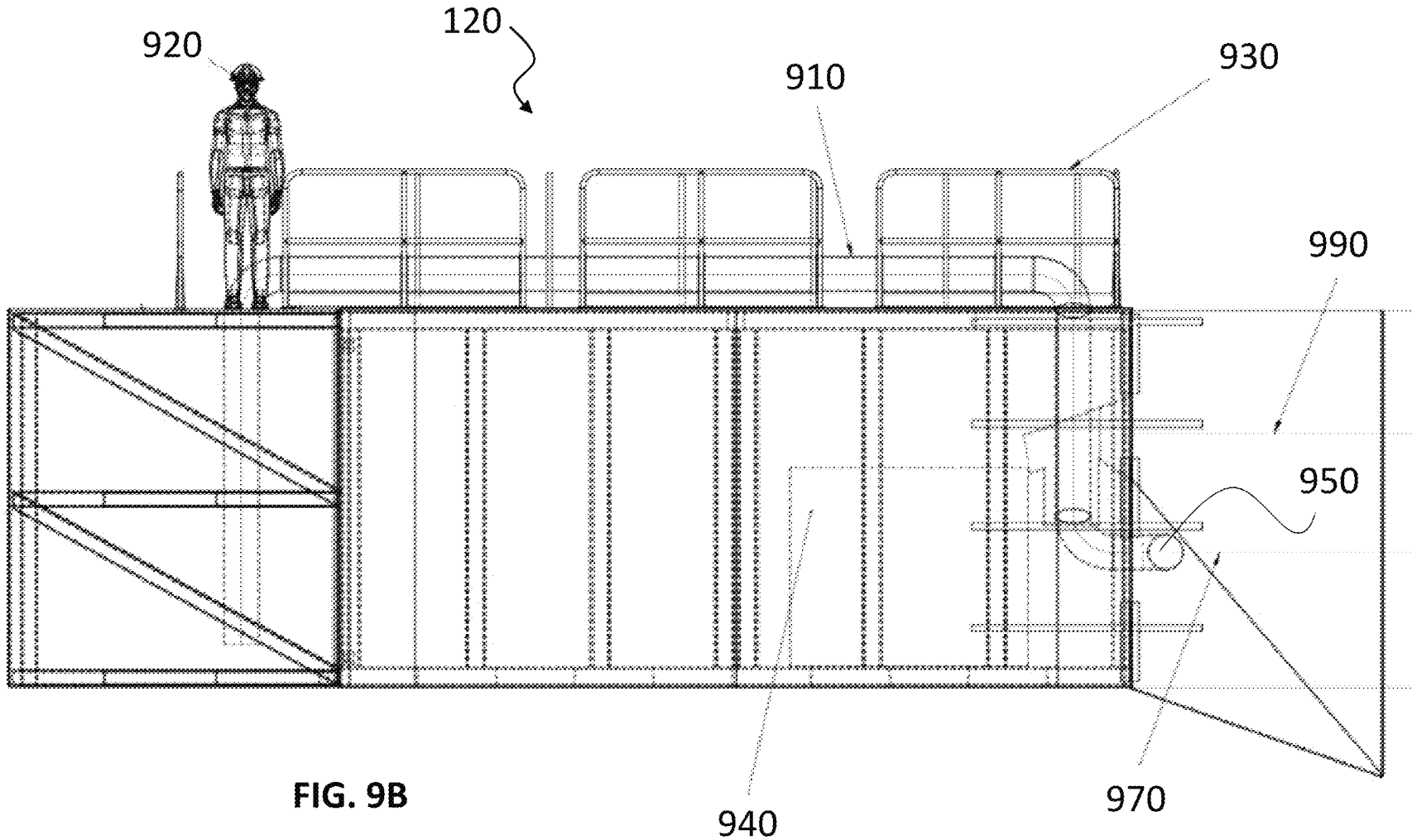

Reference is now made to FIGS. 9A-9B showing perspective and side views of a module body 120 according to an embodiment. As discussed above, the body 120 includes a pump 410 coupled to a portion of the body 120, where the pump 410 is configured to alter at least one flow field 170, 180. The pump 410 may be in fluid communication with a siphon pump pipe 910 and water flowing from the siphon pump pipe 910 can exit an opening 950 providing auxiliary attraction flow with an attraction flow pipe centerline 970. In one embodiment, the top of the body 120 may also be large enough such that a worker 920 can walk about an upper surface of the body 120 and safety railings 930 may be installed throughout the same upper surface. In another embodiment, the body 120 may further include a center line of fish faucet (water line) 990.

In one embodiment, the interior of the body 120 may also include a tank 940 for housing fish that come out of the fish faucet (e.g., via fish faucet center line 990). The tank 940 may be filled with water as well as the surrounding area to ensure fish safety. In addition, the tank 940 as well as various areas within the body 120 may have rounded corners to ensure fish safety if fish should escape the tank 940 holding area.

Figure 10A:
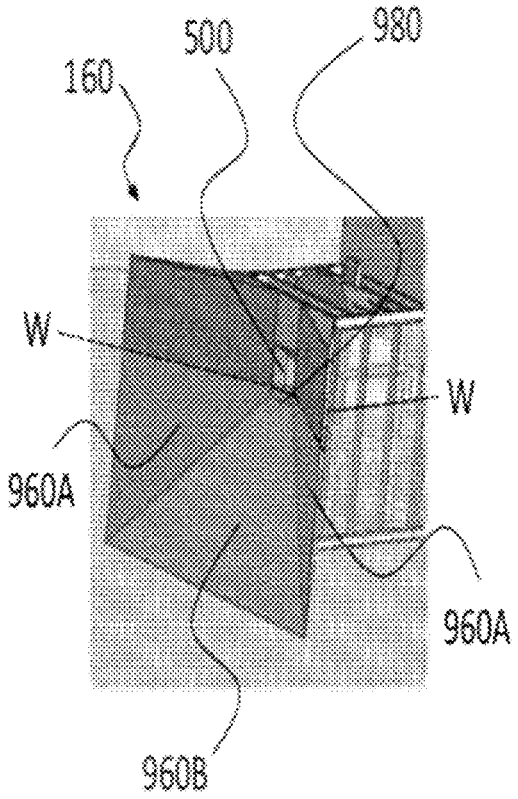
FIGS. 10A-10B are perspective views of a fish passage attraction module.
Figure 10B:
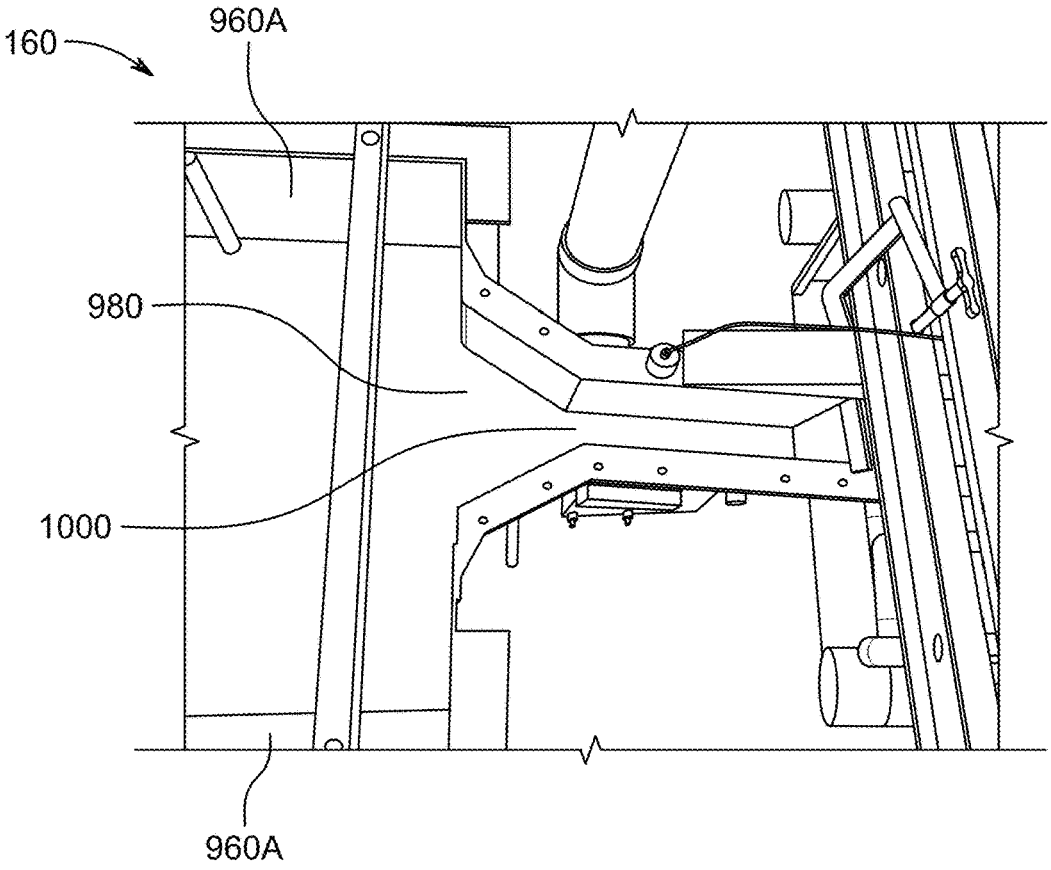

Reference is now made to FIGS. 10A-10B showing perspective views of downstream adaptor 160 of a fish passage attraction module 100. In one embodiment, the downstream adaptor 160 may include a bottom ramp 960B extending from the downstream end 150 of the body 120, where the bottom ramp 960B is configured to funnel inwardly toward an opening 500. In another embodiment, the downstream adaptors 160 may include a side ramp 960A extending from the downstream end 150 of the body 120, where the side ramp 960A is configured to funnel inwardly toward an opening 500. In yet another embodiment, the downstream adaptor 160 may include side ramps 960A and a bottom ramp 960B in forming a funnel-like structure for funneling water as well as fish inwardly toward the opening 500.

In one embodiment, the opening 500 may include a horizontal bottom edge 980 that is below the surface of the water (W-W water line), with a false weir 1000 next to it that is about one inch to about two inches above the surface of the tailwater. In another embodiment, the false weir 1000 may be about an inch or two above the surface of the tailwater with about 1-2 cfs of water flow going over it.

In one embodiment, the module 100 includes an opening 500 in a downstream end 150 of the body 120, the opening 500 having a horizontal bottom edge 980. In this embodiment, the horizontal bottom edge 980 is positioned below water surface (e.g., dashed W-W water line). Also in this embodiment, the water surface is adjacent a false weir 1000 that is about one inch to about six inches above the water surface.

While example embodiments have been particularly shown and described, it will be understood by those skilled in the art that various changes in form and details may be made therein without departing from the scope of the embodiments encompassed by the appended claims. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A fish passage attraction module located downstream of a facility where water flows downstream, the module comprising:

a floating, partially submergible body;

a mooring apparatus that connects the body to a riverbed in a tailrace, the mooring apparatus configured to allow the body to move up and down with water elevation; and an adaptor adjacent the body, the adaptor comprising opposing baffles, each baffle having a tapered structure with adjustable angles so as to alter a plurality of flow fields adjacent the body, wherein a first flow field of the plurality of flow fields is slower than a second flow field of the plurality of flow fields, and wherein the first flow field is closer to a central longitudinal axis than the second flow field;

wherein the body includes a downstream end and an upstream end opposite the downstream end, wherein the adaptor is adjacent the downstream end of the body, and wherein the module is configured to encourage fish to enter the body from the downstream end of the body and travel safely upstream of the facility.

2. The module of claim 1, wherein the adaptor is a first adaptor adjacent the downstream end of the body, the module further comprising:

a second adaptor adjacent the upstream end of the body, the second adaptor having a conical structure so as to alter at least one of the first flow field and the second flow field.

3. The module of claim 2, wherein the at least one of the first adaptor and the second adaptor can be switched to accommodate structures of different sizes.

4. The module of claim 2, wherein the body includes a peripheral surface between the downstream end and the upstream end, the module further comprising: a third adaptor adjacent the peripheral surface, the third adaptor having a geometrical structure so as to alter at least one of the first flow field and the second flow field.

5. The module of claim 1, further comprising a pump coupled to a portion of the body, the pump configured to alter at least one of the first flow field and the second flow field.

6. The module of claim 1, further comprising a device coupled to a portion of the body, the device configured to attract a variety of fish.

7. The module of claim 1, further comprising an opening in a downstream end of the body, the opening having a horizontal bottom edge positioned below water surface, wherein the water surface is adjacent a false weir that is about one inch to about six inches above the water surface.

8. The module of claim 7, further comprising a bottom ramp extending from the downstream end of the body, the bottom ramp configured to funnel inwardly toward the opening.

9. The module of claim 7, further comprising a side ramp extending from the downstream end of the body, the side ramp configured to funnel inwardly toward the opening.

10. The module of claim 7, further comprising a tubular structure coupled to a portion of the body, the tubular structure configured to move fish from the opening to a different location.

11. A fish passage attraction module located downstream of a facility where water flows downstream, the module comprising:

a floating, partially submergible body having a downstream end and an upstream end opposite the downstream end;

a mooring apparatus that connects the body to a riverbed in a tailrace, the mooring apparatus configured to allow the body to move up and down with water elevation;

a first adaptor adjacent the downstream end of the body, the first adaptor having first geometric structure defined by opposing adjustable baffles, each baffle comprising a tapered structure so as to alter a plurality of flow fields adjacent the body, wherein a first flow field of the plurality of flow fields is slower than a second flow field of the plurality of flow fields, and wherein the first flow field is closer to a central longitudinal axis than the second flow field such that greater number of fish is attracted to move toward the first flow field than the second flow field; and a second adaptor adjacent the upstream end of the body, the second adaptor having second geometric structure so as to alter at least one of the first flow field and the second flow field;

wherein the module is configured to encourage fish to move toward the first flow field and ultimately enter the body from the downstream end of the body and travel safely upstream of the facility.

12. The module of claim 11, wherein the second geometric structure is a conical structure, and wherein at least one of the tapered structure and the conical structure can be switched to accommodate structures of different sizes.

13. The module of claim 11, wherein the body includes a peripheral surface between the downstream end and the upstream end, the module further comprising: a third adaptor adjacent the peripheral surface, the third adaptor having third geometric structure so as to alter at least one of the first flow field and the second flow field.

14. The module of claim 11, further comprising a pump and a device each coupled to a portion of the body, the pump configured to alter at least one of the first flow field and the second flow field, and the device configured to attract a variety of fish.

15. The module of claim 11, further comprising:

an opening in the downstream end of the body, the opening having a horizontal bottom edge positioned below water surface, wherein the water surface is adjacent a false weir that is about one inch to about six inches above the water surface;

a bottom ramp extending from the downstream end of the body, the bottom ramp configured to funnel inwardly toward the opening; and a side ramp extending from the downstream end of the body, the side ramp configured to funnel inwardly toward the opening.

16. A zero-ascend omnispecies (ZAO) attraction system comprising:

a facility where water flows downstream; and a fish passage module located downstream of the facility where water flows downstream, the module comprising:

a floating, partially submergible body having a downstream end and an upstream end opposite the downstream end;

a mooring apparatus that connects the body to a riverbed in a tailrace of the facility, the mooring apparatus configured to allow the body to move up and down with water elevation;

a first adaptor adjacent the downstream end of the body, the first adaptor having first and second adjustable opposing tapered structures so as to alter a plurality of flow fields adjacent the body, wherein a first flow field of the plurality of flow fields is slower than a second flow field of the plurality of flow fields, and wherein the first flow field is closer to a central longitudinal axis than the second flow field such that greater number of fish is attracted to move toward the first flow field than the second flow field; and a second adaptor adjacent the upstream end of the body, the second adaptor having an adjustable geometric structure so as to alter at least one of the first flow field and the second flow field; and wherein the module is configured to encourage fish to move toward the first flow field and ultimately enter the body from the downstream end of the body and travel safely upstream of the facility.

17. The system of claim 16, wherein the facility is at least one of hydropower facility, hydroelectric facility, and spillway.

18. The system of claim 16, wherein the module is mobile and can be readily moved about anywhere downstream of the facility.

19. The system of claim 16, wherein the facility is a hydropower facility and wherein the module is positioned in a tailrace at a location in or near turbine outflow of the facility.

20. The system of claim 16, wherein the body includes a peripheral surface between the first end and the second end, the module further comprising third adaptor adjacent the peripheral surface, the third adaptor configured to alter at least one of the first flow field and the second flow field.

* * * * *